US005755130A

United States Patent [19]

Tung et al.

[11] Patent Number: 5,755,130

[45] Date of Patent: May 26, 1998

[54] METHOD AND PUNCH FOR NECKING CANS

[75] Inventors: Thomas T. Tung, Barrington; Manny Klapper, Wheeling; Andy Halasz, Crystal Lake, all of Ill.; Jean Proubet; Joël Courbon, both of Grenoble, France; Rene Ménéghin, La Musette, France

[73] Assignee: American National Can Co., Chicago, Ill.

[21] Appl. No.: 813,342

[22] Filed: Mar. 7, 1997

[51] Int. Cl.[6] ..... B21D 51/26

[52] U.S. Cl. ..... 72/60; 72/379.4; 72/466; 413/69

[58] Field of Search ..... 72/60, 352, 348, 72/379.4, 465.1, 466; 413/1, 69

[56] References Cited

U.S. PATENT DOCUMENTS

| | | |
|---|---|---|
| 271,281 | 11/1883 | Abbott et al. . |
| 2,375,574 | 5/1945 | Metheny et al. . |
| 2,742,873 | 4/1956 | Moore . |
| 3,029,507 | 4/1962 | Gaggini . |
| 3,051,112 | 8/1962 | Van Leer et al. . |
| 3,173,174 | 3/1965 | Edwards . |
| 3,224,239 | 12/1965 | Hansson . |
| 3,397,563 | 8/1968 | Pelton . |
| 3,468,153 | 9/1969 | Patarini et al. . |
| 3,593,559 | 7/1971 | Hinshaw . |
| 3,680,350 | 8/1972 | Pavleszek et al. . |
| 3,687,098 | 8/1972 | Maytag . |
| 3,698,337 | 10/1972 | Brawner et al. . |
| 3,808,868 | 5/1974 | Wolfe . |
| 3,953,994 | 5/1976 | Brawner et al. . |
| 3,964,413 | 6/1976 | Saunders . |
| 4,173,883 | 11/1979 | Boik . |
| 4,261,193 | 4/1981 | Boik . |
| 4,266,685 | 5/1981 | Lee, Jr. . |
| 4,280,353 | 7/1981 | Murphy . |
| 4,316,375 | 2/1982 | Lee, Jr. . |
| 4,320,568 | 3/1982 | Herrod et al. . |
| 4,341,103 | 7/1982 | Escallon et al. . |
| 4,403,493 | 9/1983 | Atkinson . |
| 4,441,354 | 4/1984 | Bodega . |
| 4,446,714 | 5/1984 | Cvacho . |
| 4,457,158 | 7/1984 | Miller et al. . |
| 4,502,308 | 3/1985 | Kelly . |
| 4,512,172 | 4/1985 | Abbott et al. . |
| 4,519,232 | 5/1985 | Traczyk et al. . |
| 4,562,717 | 1/1986 | Shimizu et al. . |
| 4,563,887 | 1/1986 | Bressan et al. . |
| 4,606,207 | 8/1986 | Slade . |
| 4,693,108 | 9/1987 | Traczyk . |
| 4,723,430 | 2/1988 | Hahn . |
| 4,732,027 | 3/1988 | Traczyk et al. . |

(List continued on next page.)

FOREIGN PATENT DOCUMENTS 62-267028A 11/1987 Japan .

*Primary Examiner*—Lowell A. Larson

*Attorney, Agent, or Firm*—McDonnell Boehnen Hulbert & Berghoff

[57] ABSTRACT

A method is described for reducing the diameter of the open end of a can, such as a beverage can, in a necking station while substantially preventing the formation of pleats in the can. The necking station includes a deformable support punch that is positioned within the open end of the can. The punch includes an elastomeric sleeve and a means for providing for lateral deformation of the sleeve, such as an actuator making an interference fit with the sleeve. In the necking station, the can is inserted into a necking die having a transition zone separating an outer cylindrical bore and an inner bore having a reduced diameter. When the top edge of the can is forced past the transition zone in to the inner bore to reduce the dimension of the upper portion of the can, the sleeve is controllably deformed in a manner such that the lateral portion of the sleeve is placed into supporting engagement with the interior wall of the can, pressing the can against the transition zone of the die. This supporting action of the elastomeric material against the can wall during the reduction in diameter substantially avoids the formation of localized pleats.

36 Claims, 23 Drawing Sheets

U.S. PATENT DOCUMENTS 4,751,836 6/1988 Breese .
4,753,364 6/1988 Stoffel et al. .
4,760,725 8/1988 Halasz .
4,774,839 10/1988 Caleffi et al. .
4,781,047 11/1988 Bressan et al. .
5,018,374 5/1991 Montano .
5,018,379 5/1991 Shirai et al. .
5,076,087 12/1991 Slater .
5,138,858 8/1992 Johnson et al. .
5,187,962 2/1993 Bilko et al. .
5,205,146 4/1993 Wilkins et al. .
5,282,375 2/1994 Lee, Jr. et al. .
5,297,414 3/1994 Sainz .
5,355,710 10/1994 Diekhoff .
5,448,903 9/1995 Johnson .
5,469,729 11/1995 Hager .
5,533,373 7/1996 Plester .
5,553,826 9/1996 Schultz .
5,557,963 9/1996 Diekhoff .

METHOD AND PUNCH FOR NECKING CANS

BACKGROUND OF THE INVENTION

A. Field of the Invention

This invention relates to a method for manufacturing cans that have neck features, such as beverage cans.

B. Description of the Related Art

It is known in the art of can manufacturing that neck features at the top of a thin-walled can may be formed using one or more necking stations. A necking station typically comprises a stationary necking die, a platform supporting the can and moving the can relative to the die, and a moveable punch or form control member placed within the die. The die is typically designed to have a lower cylindrical surface with a dimension equal to the diameter of the can, a curved transition zone, and a reduced diameter upper cylindrical surface above the transition zone.

During a necking operation, the platform and can are moved up into the die such that the top of the can is placed into touching contact with the transition zone of the die. The punch is positioned within the open top of the can. As the can is moved further upward into the die, the upper region of the can is forced past the transition zone into a snug position between the inner reduced diameter surface of the die and a form control member or sleeve located at the lower portion of the punch. The diameter of the upper region of the can is thereby given a reduced dimension by the die. A curvature is formed in the can wall corresponding to the surface configuration of the transition zone of the die. The can is then lowered out of the die.

After the curvature of the upper end of the can is formed, the can is moved on to subsequent processing stations, e.g., a flanging station. If the diameter of the can neck needs to be reduced even further, as is more often the case, the can is removed from the first necking station to a second necking station. In the second necking station, the reduced cylindrical neck portion is further reduced in diameter by compression of the metal therein, in a second necking operation similar to process described above.

A patent describing this process and the associated equipment in more detail is U.S. Pat. No. 4,774,839 to Caleffi et al., which is incorporated by reference herein. Other prior art references related to this general method are Traczyk, U.S. Pat. No. 4,693,108, Atkinson, U.S. Pat. No. 4,403,493; and Sainz, U.S. Pat. No. 5,297,414.

The prior art has also recognized that pleats, i.e., localized and permanent inward displacement of the can wall, may be formed in the neck and its transition (i.e., the area of the can neck between the original diameter of the neck and the reduced diameter of the neck) during the necking operation. With the trend in the industry towards thinner walled cans in order to save materials, the problem of preventing pleats has become a more critical issue. Thin walled cans are more prone to the formation of pleats since there is less material to absorb compression loads on the top of the can during the necking operation.

Various attempts to alleviate problems associated with pleats or wrinkles have been proposed in the prior art. A common approach has been to form a neck that has a plurality of reduced diameter portions, see, e.g., the above-referenced Atkinson patent. Another approach has been to provide a short "control neck" (sometimes referred to as a "pre-neck") in the top of the can in a first forming operation and then totally reforming the control neck and the adjacent portion of the sidewall to form a second reduced diameter neck. See, e.g., the above-referenced Sainz patent. The above-referenced Caleffi et al. patent suggests that, by precise control of the dimensions and tolerances of the inner cylindrical surface of the die above the transition zone and the external surface diameter of a forming sleeve at the bottom of the punch, dents or imperfections are removed or minimized. Further, in Caleffi et al. the entire portion of the neck formed in the previous forming operation is not reformed in a subsequent necking operations, but rather a portion is reformed and the reduced diameter neck is extended incrementally towards the top of the can.

The present invention represents a significant departure from the attempts proposed by these and other prior art references. Whereas the above-described techniques are primarily concerned with the forming process in terms of the number of reduced diameter portions, and whether or not the reduced diameter portion should be reformed in a subsequent necking step, the present inventors have studied the interaction of the can and the die as the can is given a reduced diameter to better understand how localized lateral or inward deformations such as pleats are formed in the first place. The inventors have discovered that stresses in the can material during the process of dimensional reduction which lead to localized formation of pleats can be substantially prevented by providing sufficient supporting forces to the interior surface of the can wall to prevent such localized movement, that is, by providing counter forces against the can wall and die while it undergoes a reduction in diameter. The forces are applied sufficient to prevent a permanent localized lateral or inward displacement of the can material (e.g., a pleat) as the can wall undergoes a reduction in diameter. Preferably, such supporting forces are imparted to the can wall by a deformable elastomeric material which continues to press against the can wall opposite the transition zone of the die while the upper portion of the can is moved upwards past the transition zone to be given a reduced diameter.

A principal object of the present invention provides a method for forming neck or other reduced diameter features on thin walled cans, while substantially preventing the formation of pleats in the can wall.

A further object of the invention is to provide novel deformable support punch designs for use in a necking station that cooperate with the can and die to provide support for the can body against the die to thereby prevent pleats from forming during the operation of reducing the dimension of the can.

A further object of the invention is to provide a method for forming neck features at the top of can that allows the cans to be made with relatively thin walls, thereby reducing the amount of material used in the can and achieving a cost savings in producing the can.

A further object of the invention is to provide a method for forming neck features at the top of can that may enable fewer necking stations to be used in the process of forming the final shape of the can neck.

These and other objects of the invention will be come more apparent from the following detailed description of preferred and alternative embodiments of the invention.

SUMMARY OF THE INVENTION

The occurrence of pleats in the can at the neck can be substantially reduced by providing a sufficient supporting force to the can wall to press the can wall against the die transition zone while the can is moved relative to the die to reduce the dimension of the can. This support for the can against the die is preferably provided by a deformable support punch having an elastomeric material that is placed adjacent to the inner surface of can opposite from the transition zone. The elastomeric material is deformed, either by mechanical interference or by other suitable means, such that during the necking operation the elastomeric material is pressed against the interior surface of the can and applies a sufficient supporting force to the can wall to ease the smooth flow of material past the die and prevent localized permanent inward displacement of the can material as the diameter is reduced.

In a necking station of the type described above, the invention can be advantageously practiced by providing a deformable support punch which has elastomeric material in the form of a cylindrical sleeve that is controllably deformed to provide a sufficient supporting or clamping force against the can wall from the interior thereof, pressing and supporting the can wall against the die while the can neck is given a reduced diameter.

In one form of the invention, once the can makes contact with the transition zone and the sleeve is deformed to provide the supporting force against the can wall, the sleeve is moved upward further into the die along with the can at approximately the same velocity (and therefore with substantially minimal relative movement and associated friction therebetween), with a portion thereof maintaining a supporting engagement with the can wall opposite the transition zone of the die, to prevent substantial friction between the elastomeric material and the inside surface of the can. This feature allows the punch to be used in a high speed necking system continuously for long periods of time without causing significant wear in the elastomeric material. The sleeve may be made from a self lubricating elastomeric material to further reduce friction in the event that the can and elastomeric material do not move at exactly the same rate.

Several alternative deformable support punch configurations are described. In one configuration, the punch comprises a cylindrically-shaped expandable sleeve that is expanded laterally by mechanical interference from an actuator concentrically disposed inside the sleeve. The actuator maintains a position that is stationary with respect to the die, while the sleeve moves upwards along with the can during the necking operation. The actuator operates to deform the expandable sleeve laterally into a supporting engagement with the interior wall of the can, supporting the can against the die.

An alternative deformable support punch is also described. In the alternative embodiment, an outer elastomeric sleeve and an inner concentric cylindrically-shaped block made from an elastomeric material are provided. The elastomeric block and sleeve are constrained axially and medially, and are supported at the extreme lowermost portion of the punch by a piston. When the can is inserted into the punch and into engagement with the die, air in injected into the can. The air pressure exerts forces normal to the bottom surface of the piston, causing the piston to move upwards and compress the elastomeric block and sleeve and produce a lateral expansion thereof. The sleeve is expanded laterally into supporting engagement with the interior surface of the can, supporting the can wall against the transition zone of the die as the can is moved past the transition zone to be given a reduced diameter or neck formation.

These and still other features and embodiments of the invention will be described in greater detail in the following detailed description of the preferred and alternative embodiments.

BRIEF DESCRIPTION OF THE DRAWINGS

Presently preferred and alternative embodiments of the invention are described in conjunction with the drawings, in which like reference numerals refer to like elements in the various views, and in which.

DETAILED DESCRIPTION OF THE PREFERRED AND ALTERNATIVE EMBODIMENTS OF THE INVENTION

Overview

Figure 1:
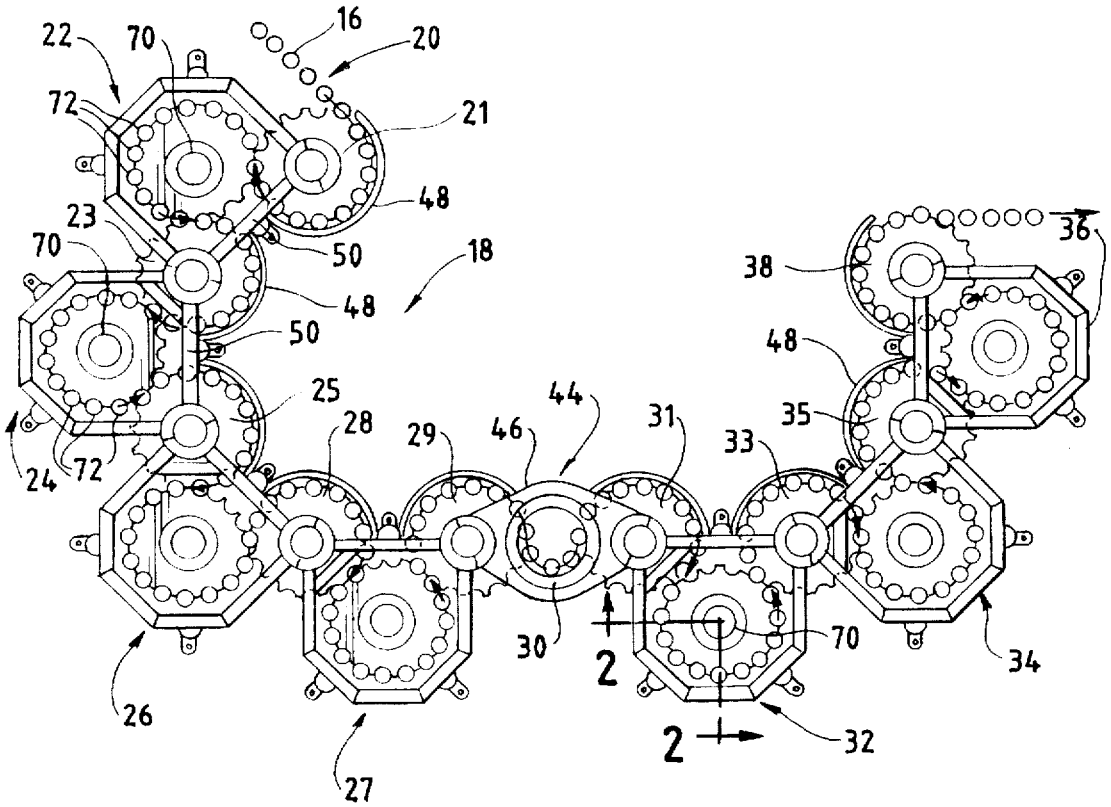
FIG. 1 is a plan view of a necking apparatus for beverage cans incorporating the deformable support punch of the present invention.
Figure 2:
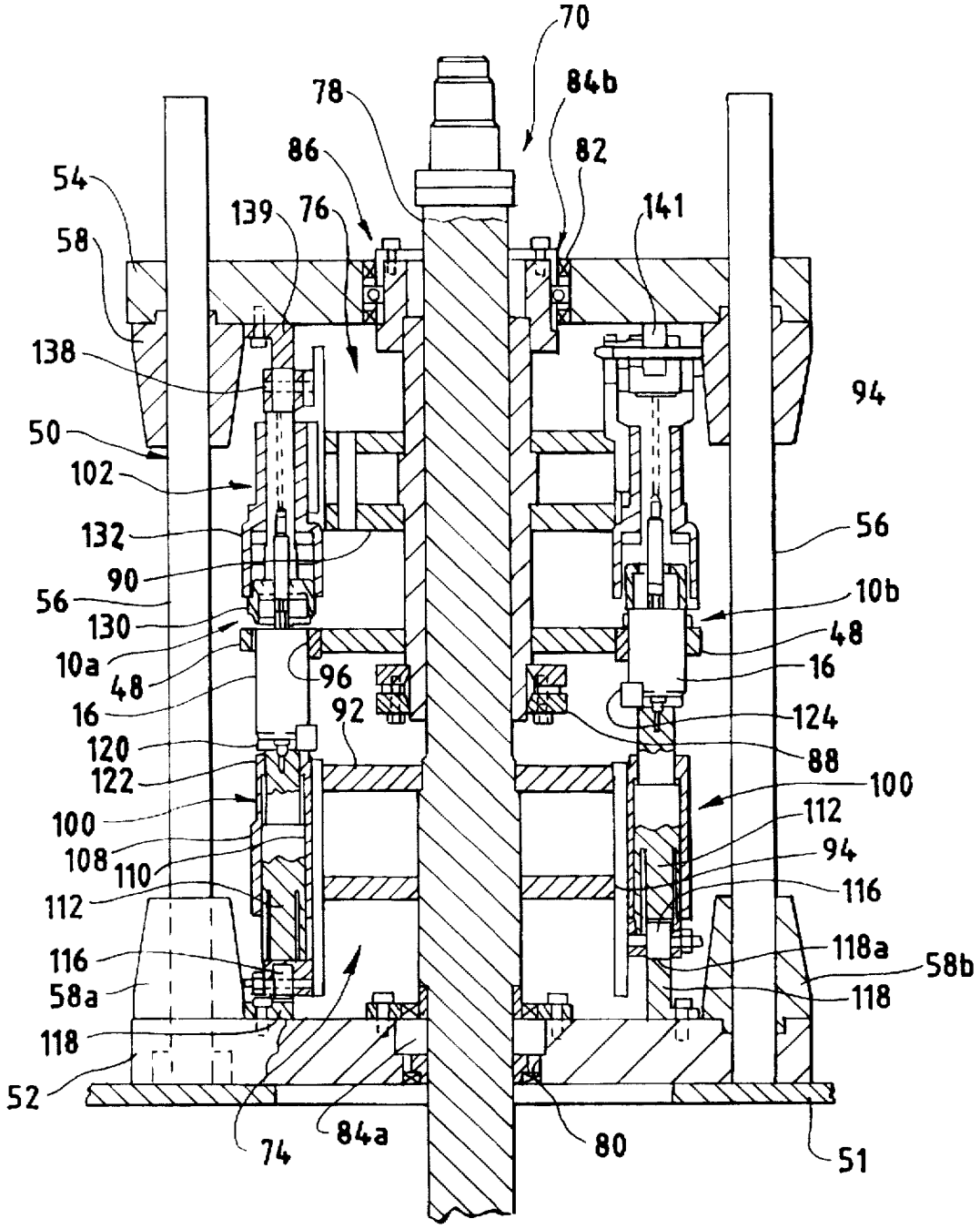
FIG. 2 is a cross-sectional view of one module of FIG. 1 showing two necking substations, as viewed along line 2—2 of FIG. 1.
Figure 3:
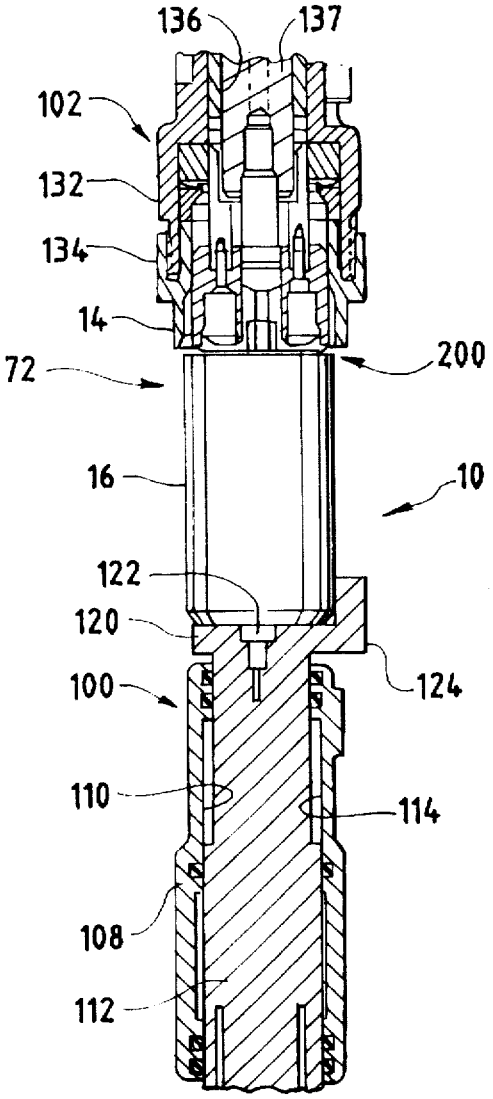
FIG. 3 is a cross-sectional view of one of the necking substations of FIG. 2.

In order to better understand the operation and construction of presently preferred and alternative embodiments of the invention and the best mode contemplated for carrying out the invention, a brief discussion of representative machinery used for necking cans is set forth in this section in conjunction with FIGS. 1–3. The specific features of the inventive method and deformable support punch are described in detail in the following sections. It will be appreciated that the scope of the present invention is not intended to be limited to the specific necking machinery illustrated in FIGS. 1–3.

FIG. 1 is a plan view of a conventional necking and flanging system known in the art, generally designated as 18, for producing cans such as aluminum beverage cans having a smooth inwardly tapered neck profile and a outwardly directed flange enabling an end to be affixed to the can. The system 18 includes a plurality of substantially identical modules comprising necking stations that are positioned in a generally C-shaped pattern, as shown in FIG. 1. The plurality of individual modules are interconnected to provide a complete necking and flanging system.

FIG. 1 depicts metal can bodies 16 being fed along a path 20 leading to the necking 20 system. The embodiment of FIG. 1 has six can necking station modules, identified by numerals 22, 24, 26, 27, 32 and 34, and a flanging module 36. A set of nine transfer wheels 21, 23, 25, 28, 29, 31, 33, 35 and 38 move the cans serially and in a serpentine path through the various necking stations.

Each of the necking station modules 22, 24, 26, 27, 32 and 34 may be substantially identical in construction so as to be interchangeable, and can be added to or subtracted from the system depending upon the type of can that is to be formed. Each of the necking station modules has a plurality of substantially identical necking substations, one of which is shown in FIG. 2. The number of stations and substations can be increased or decreased to provide the desired necking operation for various sizes of cans, with each station module having different die dimensions so as to permit the neck diameter of the can to be progressively decreased as the cans are fed sequentially through all six stations.

The deformable support punch of the present invention is preferably provided in each of the necking stations, so that pleat formation may be prevented in the course of any of the stages in the necking process. However, of course, it is possible to use the inventive punch only on some necking stations, for example in an embodiment in which some stations use die necking and one or more stations of spin necking or spin flow necking.

One of the advantages of the present invention is that the can supporting features provided by the deformable support punch can allow a fewer number of necking station modules to be used in producing the desired neck without wrinkling. The reduction in number of modules is advantageous, in that it reduces the cost of the tooling and equipment required to manufacture the can, and lowers maintenance and servicing requirements of the line.

The arrangement of FIG. 1 shows drawn and ironed one piece cylindrical metal can bodies 16 with an open top and a closed end, which are made of conventional materials (e.g., aluminum or steel) in known conventional manner. The cans are fed sequentially by a conventional conveyor system into the necking and flanging system 18. The conveyor feeds the can to a first transfer wheel 21. The cans are fed serially through the necking modules by the interconnecting transfer wheels. For example, the first transfer wheel 21 delivers cans 16 to the first necking station module 22, where a first necking operation is performed on the can. The cans 16 are then delivered to a second transfer wheel 23, which feeds the cans to a second necking module 24, where a second necking operation is performed on the can. Each station is concurrently operating on, or forming, a number of cans with each can being in a different state of necking as it is being processed from the entry point to the exit point of each necking station module.

After going through the six necking station modules, the necking of the cans is complete and the can is fed by transfer wheel 35 to a flanging station or module 36, which flanges the tops of the cans in a well known manner. The cans are then delivered to an exit conveyor for delivery to subsequent can processing equipment.

The moving members in the system 18 are driven by a single drive means 44 which includes a variable speed motor connected to an output transmission 46. Each of the transfer wheels, necking modules and flanging module have gears in mesh with each other to produce a synchronized continuous operation of all components.

Referring to FIG. 2, a suitable interconnecting and supporting framework 50 is provided for supporting rotatable turrets 70 that are part of the modules. The framework 50 is supported on a platform 51 and includes a lower frame member 52 and an upper frame 54 interconnected by columns 56. A set of collars 58 suitably connected columns 56 to the frame members 52, 54 by bolts so that a solid structure is provided to assure accuracy of alignment of the various moveable components.

The frame structure 50 provides fixed support above the base 51 for a rotary turret assembly 70 that holds a plurality of identical necking substations, generally designated as 10. FIG. 2 shows two of the substations 10A and 10B. The turret assembly 70 comprises a lower turret portion 74 and an upper turret portion 76 supported on a central drive shaft 78 that extends through openings 80 and 82 in frame members 52 and 54. Turret assembly is rotatably supported on the frame members by suitable bearing means 84*a* and 84*b*. Substations 10A and 10B, as well as the other substations, rotate with shaft 78 while columns 56 remain stationary.

The upper turret portion 76 has a hollow cylindrical shape and is slideably positioned on shaft 78, and secured in an adjusted position by a wedge mechanism 86 and a collar 88. The lower turret portion 74 is fixed to the lower part of the shaft 78.

A radially extending upper hub 90 forms part of the upper turret portion 76 and provided support for the upper portion of the necking substations 10. Likewise, the lower hub 92 extends radially outward to form part of the lower turret portion 74 and to support the lower portion of the necking substations 10. The hubs 90, 92 have aligned pockets 94 on their outer periphery which are machined as matching pairs to receive the components of the substations 10. Also, the upper hubs 90 have pockets 96 which cooperate with guide elements 48 to control the position of the cans as they are moved through the necking station module.

FIG. 3 shows in greater detail a necking substation 10. The substation 10 comprises a lower can lifting portion 100, and an upper forming or necking portion 102. Referring to FIGS. 2 and 3, the can-lifting portion 100 includes an outer cylindrical member or sleeve 108 that has a generally circular opening 110 with a ram or piston 112 reciprocally moveable in the opening 110. The lower end of ram 112 has a cam follower 116 which rides on an upper exposed camming surface of a face cam 118 supported on the lower frame member 52. The upper end of ram 112 has a can supporting platform 120 secured thereto by fastener means 122. The support platform has an inner extension 124 for engaging the inner lower surface of the can. The ram 112 cooperates with sleeve 108 to provide both a fluid centering mechanism and to bias the cam follower 116 into engagement with the cam 118. U.S. Pat. No. 4,519,232, which is incorporated by reference herein, has further details on this aspect of the station 10.

The upper necking portion 102 includes a fixed necking die element 14 that is secured to a hollow cylinder or cartridge 132 by means of a threaded cap 134. The cylinder 132 has an axial opening 136 in which a hollow rod 137 is reciprocally mounted. A cam follower 138 is mounted on the upper end of the rod 137, and reliably abuts on an exposed camming surface of a fixed upper face cam 139 secure to the upper frame member 54.

The inventive deformable support punch 200 has an actuator center guide rod 202 (shown in FIG. 5) that threads into the rod 137. The punch 200 has an elastomeric sleeve that supports the can during the necking operation, as described in detail below.

In operation of the necking station module 10, the shaft 78 is caused to rotate about a fixed axis on the stationary frame 50. The cans 16 are moved onto the platform 120 and into engagement with the extension 124 when the lower lifting portion is in the lowermost position, as shown in substation 10A on the left-hand side of FIG. 2. The configuration of the lower cam 118 is such that the can 16 is moved up into the necking die 14 as the shaft 78 is rotated, to incrementally reform the upper open end of the can 16. At about the time the upper edge of the can 16 contacts the die 14, pressurized air is introduced into the can from a source (not shown) through opening 141. As the turret assembly is rotated, the upper cam 139 is configured to allow the deformable support punch 200 to move upwardly. The rod 137 in the punch 200 is biased upwardly by fluid pressure and moves upwardly to the position shown at substation 10B as the turret assembly rotates. Thereafter, during the remainder of the 360 degrees of rotation, the cams 118 and 139 are configured to return the platform 120 and punch 200 to their lowermost positions while the necked can 16 is removed from the die. During the downward movement, the pressurized air in the can forces the can to be released from the die onto the platform 120. The cans are continually being introduced into the platform 120, processed and removed as indicated in FIG. 1.

Further details concerning the overall configuration and operation of the modules of FIGS. 1–3 are known in the art and described in detail in U.S. Pat. No. 4,774,839, and U.S. Pat. No. 4,693,108, both of which are incorporated by reference herein.

As the cost of materials for making drawn and ironed one-piece cans has increased, efforts have been made to reduce the quantity of material to a minimum while maintaining the integrity of the can body. The thickness of the sidewall and topwall of the can is an area of primary interest. The reduction in metal thickness of the can body has resulted in inherent problems in producing a necked-in can utilizing a conventional annular necking die, such as in the manner generally described above. This is particularly true where the containers are processed on high speed equipment.

In trying to reduce the sidewall and topwall thickness in order to save materials, it has been found necessary to go through many small necking steps to avoid the formation of pleats in the topwall of the can, i.e., a permanent localized lateral displacement or buckling of the can material. For example, for an aluminum can with a neck thickness of 0.0063 inches, in order to reduce the can diameter from 2.599 inches down to 2.074 inches, it currently requires approximately 10 stations of necking equipment, each of which represents a substantial investment of capital and tooling.

In order to go to an even thinner can topwall with the same diameter reduction, if the metal thickness is reduced to 0.0054 inches, it would be necessary to go to approximately 16 conventional die necking stations, representing a substantial additional capital expenditure. One reason for the substantial increase in the number of stations is that the thinner metal thickness requires that the can be necked with a smaller diameter change in each station to avoid the pleating phenomenon. The present invention provides a method which eases this restriction on the diameter reduction that may be achieved at each necking station with a very thin can topwall, and without formation of pleats. The invention achieves a reduction in the amount of material used to manufacture the can, while avoiding a substantial increase in the number of necking stations required to manufacture the can.

Discussion of Deformable Support Punches and Method for Prevention of Pleats

Figure 4:
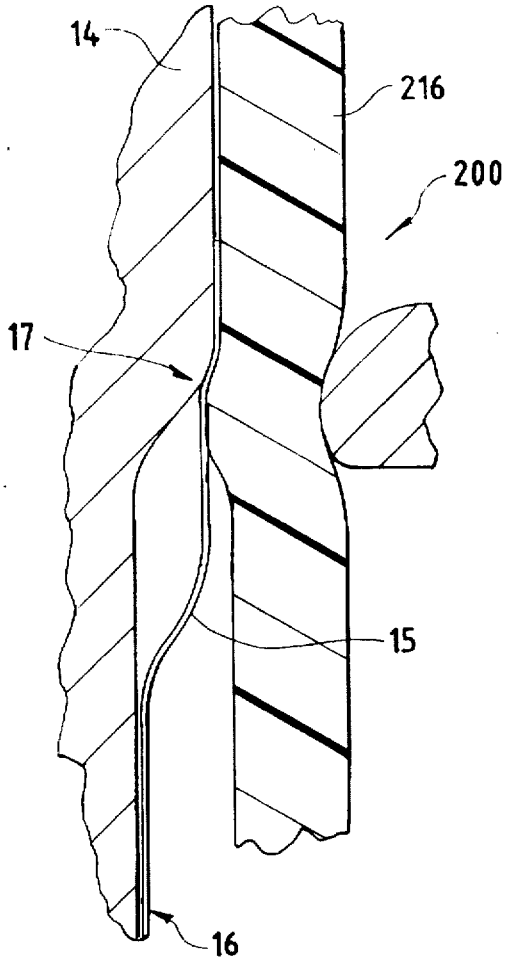
FIG. 4 is a cross sectional view of the die, can and deformable support punch of FIG. 3 shown greatly enlarged in order to better illustrate the supporting features of the present invention.

Referring now to FIG. 4, we have recognized that the occurrence of pleats in the can 16 in the vicinity of the neck can be substantially reduced by providing a sufficient supporting force to the can wall 15 to press the can 16 in the region of the die transition zone 17 while the can is moved relative to the die 14 to reduce the dimension of the can. This support for the can in proximity to the die 14 is preferably provided by a deformable support punch 200 having an elastomeric material 216 that is placed adjacent to the inner surface of can 16 opposite from the convex surface of the transition zone 17 of the die 14. The elastomeric material 216 is preferably deformed, either by mechanical interference (as shown in FIG. 4) or by other suitable means, such that during the necking operation the elastomeric material 216 is pressed into supporting engagement with the interior surface of the can in a manner to apply the supporting force to the can wall 15 as the can wall is forced past the transition zone 17 in the die to give it a reduced s dimension. The amount of support that is sufficient to prevent localized lateral or inward displacement and pleat formation depends on the thickness of the can wall, the can material, and the hardness of the supporting elastomeric material 19. The goal is to have the can material undergo a smooth flow during the reduction in diameter. For thin walled aluminum beverage cans of between 3 and 7 thousands of an inch in thickness, it is presently believed that a supporting force of between 15 and 150 pounds per square inch is sufficient, with a range of between 20 and about 80 pounds per square inch a more preferred range, and with about 30 pounds per square inch a preferred embodiment. Steel containers of between 2 and 7 thousandths of an inch may benefit from the supporting features described herein, but with a higher range of necessary supporting forces than for aluminum.

The invention can be implemented in a variety of different deformable support punch designs. Several presently preferred embodiments are described in detail below. One embodiment, described first, is based on a mechanical interference with an elastomeric sleeve to expand the sleeve outwardly into supporting engagement with the can wall, similar to that shown in FIG. 4. Several other embodiments are described later, which take advantage of the pressurization of the can during the forming process to squeeze an elastomeric actuator and induce a lateral deformation in the actuator.

Figure 5:
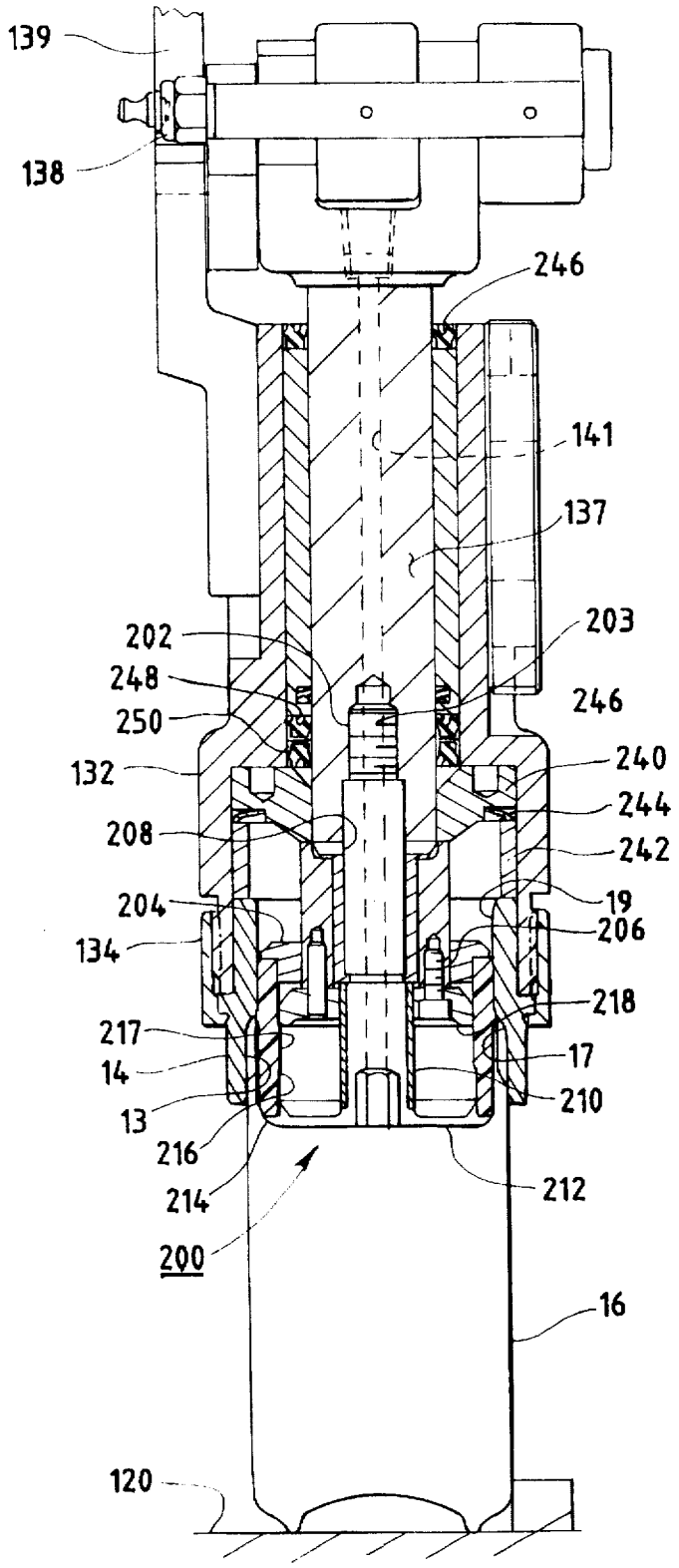
FIG. 5 is a more detailed cross sectional view of the necking station of FIG. 3.

Deformable Support Punch Embodiment With Actuator Forcibly Expanding an Elastomeric Sleeve One embodiment of a deformable support punch 200 in accordance with the invention is illustrated in cross section in FIG. 5. The deformable support punch 200 includes an actuator center guide rod 202 that makes a threaded engagement with the lower portion of the rod 137. The guide rod 202 has a central bore 203 to allow compressed air entering the rod 137 from a source to pass through the guide rod 202 and enter the can 16 during the necking operation. An upper flange nut 204 having a circular opening 206 threads onto the middle portion 208 of the actuator center guide rod 202. The lower portion of the guide rod 202 has a bronze collar 210 and lower circularly shaped plate 212.

The die assembly of FIG. 5 further includes an annular main guide 240, a necking die upper spacer 242, and a wave spring washer 244 which maintains the spacer 242 and main guide 240 in a secure arrangement with the die 14 without requiring the spacer 242 to be manufactured to exact tolerances. The rod 137 reciprocates within the opening 246 defined by the inner walls of the main guide 240. Three annular seals 246, 248 and 250 seal against the exterior walls of the rod 137 to prevent any oil or lubricant from entering the region around the punch 200.

The support punch 200 reciprocates axially within the die 14. The lateral flange portion of the upper flange nut 204 and lateral rim 214 of the plate 212 support and axially constrain an elastomeric deformable sleeve 216 which is part of the deformable support punch assembly 200. The sleeve 216 is deformed laterally towards the transition zone 17 of the die by means of mechanical interference between the wall 217 of the sleeve 216 and a rigid, ring-shaped actuator 218.

Figure 6A:
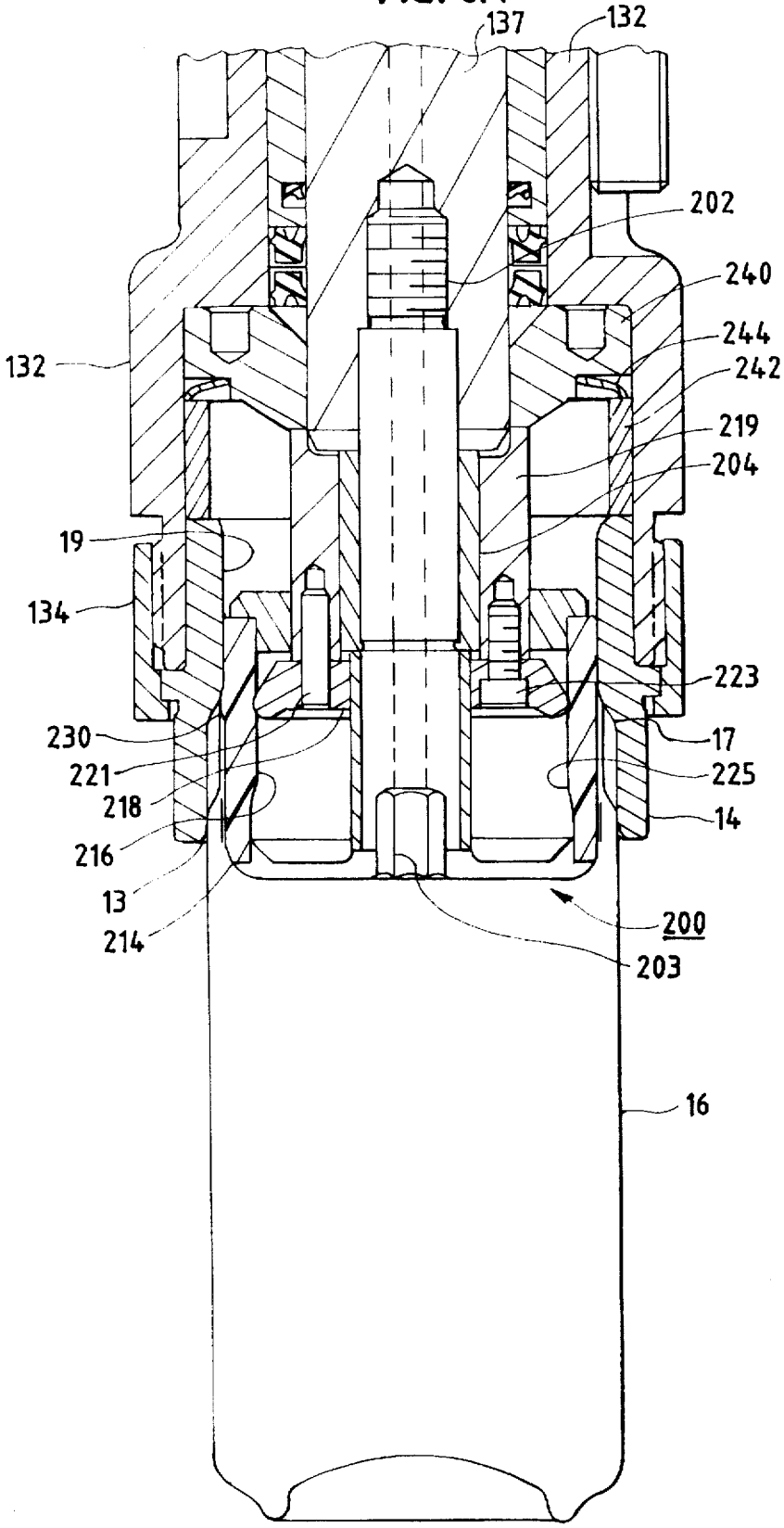
FIG. 6A is a cross-sectional view of the deformable support punch and die of FIGS. 3 and 5A when the can is inserted into the die to the point where the upper edge of the can makes initial contact with the transition zone of the die.

Referring to FIGS. 5 and 6A, the actuator 218 is stationary and fixedly mounted with respect to the die 14. The actuator 218 is secured to two arcuate or C-shaped vertical columns 219 extending above the actuator 218 by means of several oppositely positioned dowel pins 221 and set screws 223. The columns 219 are mounted to the main guide 240 and maintained in a rigid, stationary assembly relative to the die 14. When the sleeve 216 moves upward with the can 16 during the necking operation, the medial surface 225 of the sleeve 216 slides over the lateral portion of the actuator 218. The actuator 218 remains opposite the transition zone of the die 14 to deform the sleeve 216 laterally into a pressing engagement with the interior surface of the upper portion of the can 16, thereby providing a supporting force to the can near the convex transition zone surface 17 of the die 14. This supporting force has been found to substantially prevent localized buckling or permanent inward displacement of the can neck during the necking operation by promoting a smooth flow in the material past the transition zone 14.

Figure 6B:
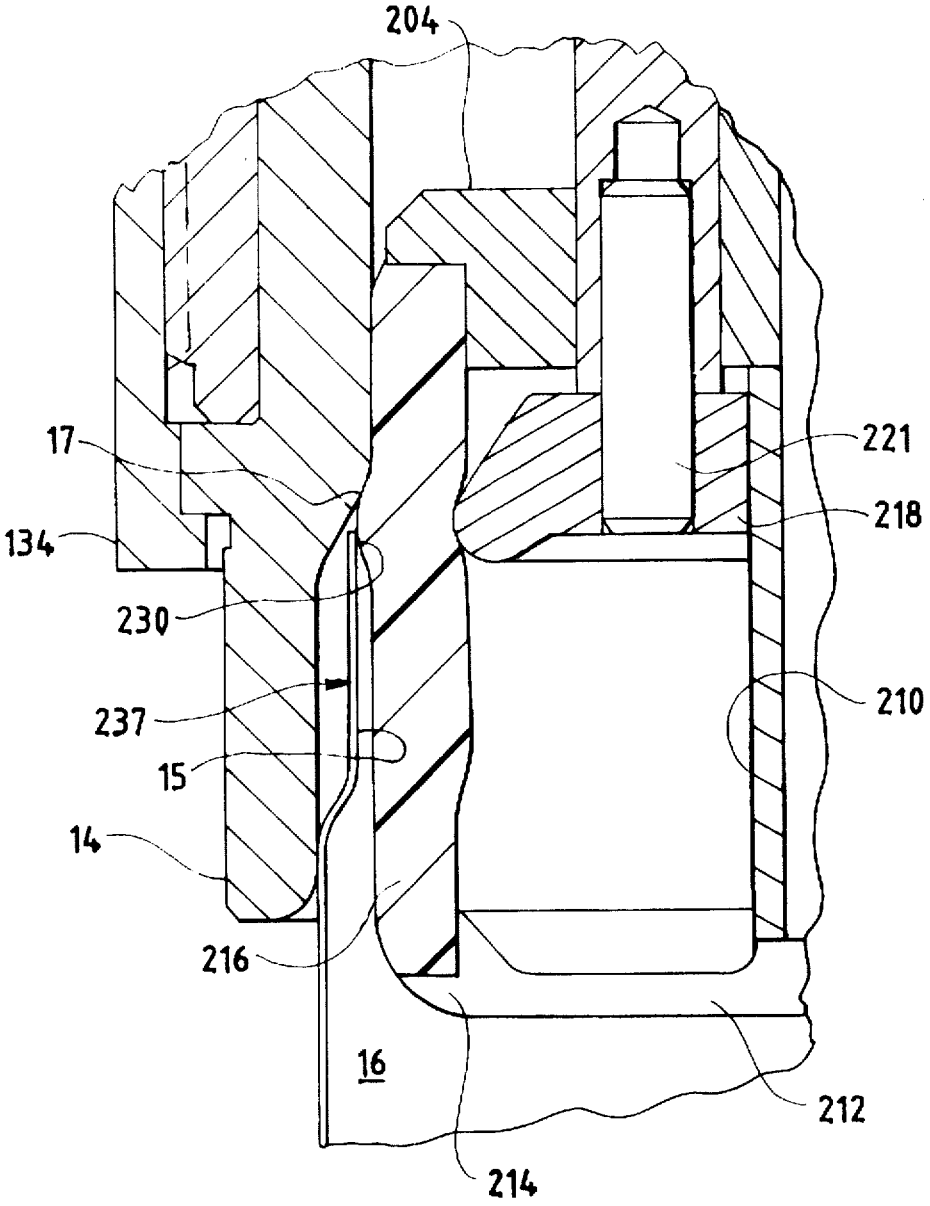
FIG. 6B is a cross-sectional view of a portion of the die and deformable support punch of FIG. 6A shown greatly enlarged.

As can be seen by FIGS. 6–8, the elastomeric sleeve 216 has an axial height sufficiently great such that the actuator 218 continues to deform a portion of the sleeve 216 into supporting engagement with the interior surface of the can 16 as the sleeve 216 is moved upwardly with the can 16 into the die 14. The diameter of the actuator 218 is greater than the inside diameter of the upper and middle portions of the sleeve 216, thereby providing an interference fit inducing a lateral deformation in the sleeve 216, as shown in FIG. 6B.

The cooperation of the actuator 218 and sleeve 216 to support the can during one representative necking operation will now be explained in conjunction with FIGS. 6A–6B, 7A–7B, and 8A–8B. FIG. 6A is a cross-sectional view of the deformable support punch 200 and die 14 of FIG. 5 when the can 16 is inserted into the die 14 to the point where the upper edge 230 of the can 16 makes initial contact with the transition zone 17 of the die 14. FIG. 6B is a cross-sectional view of a portion of the die and punch of FIG. 6A shown greatly enlarged, showing the upper edge 230 as it meets the die 14. Note that the actuator 218 is positioned opposite the transition zone 17 of the die 14, expanding the elastomeric sleeve 216 laterally. As the can moves further upwards, the upper edge 230 of the can 16 is forced past the transition zone 17. The sleeve 216 provides a supporting force against the can wall 15 during the reduction in diameter of the upper portion 237 of the can later in the necking operation.

This supporting action will be more apparent by considering FIG. 7A, which is a cross-sectional view of the deformable support punch and die later in the necking operation. FIG. 7B is a cross-sectional view of a portion of the die 14 and punch 200 of FIG. 7A greatly enlarged. These figures showing the support of the can 16 during the necking operation as the upper region of the can 16 is moved past the transition zone 17 of the die. Note that the actuator 218 deforms the elastomeric sleeve 216 so as to provide a supporting force against the interior surface of the upper region of the can 16 during the necking operation. In the preferred embodiment, a comparison of FIG. 7A to FIG. 6A reveals that as the can 16 is moved further into the die 14, the punch 200 is also moved upwards into the die 14. The portion of the can 16 that is above the transition zone in the reduced diameter region of the die is preferably supported by the upper portion 239 of the sleeve which is also above the transition zone, in the manner described in the Caleffi et al. patent.

Preferably, the upward motion of the deformable support punch 200 is at substantially the same or slightly higher velocity as that of the platform 120 and can 16, so as to minimize friction between the exterior surface of the sleeve 216 and the inside wall of the can 16. A variation in relative velocity of the can and the sleeve of +/−5% is considered optimal in a high speed necking system which produces relatively minimal friction, but the relative velocity may vary to a greater extent in a lower speed necking station, if adequate lubrication is provided, or if the sleeve material is able to withstand friction due to the relative movement for a long period of time. Further, the sleeve need not necessary move upwards with the can, but rather may remain stationary relative to the die, although this would be a less preferred embodiment for a high speed necking system.

Figure 7A:
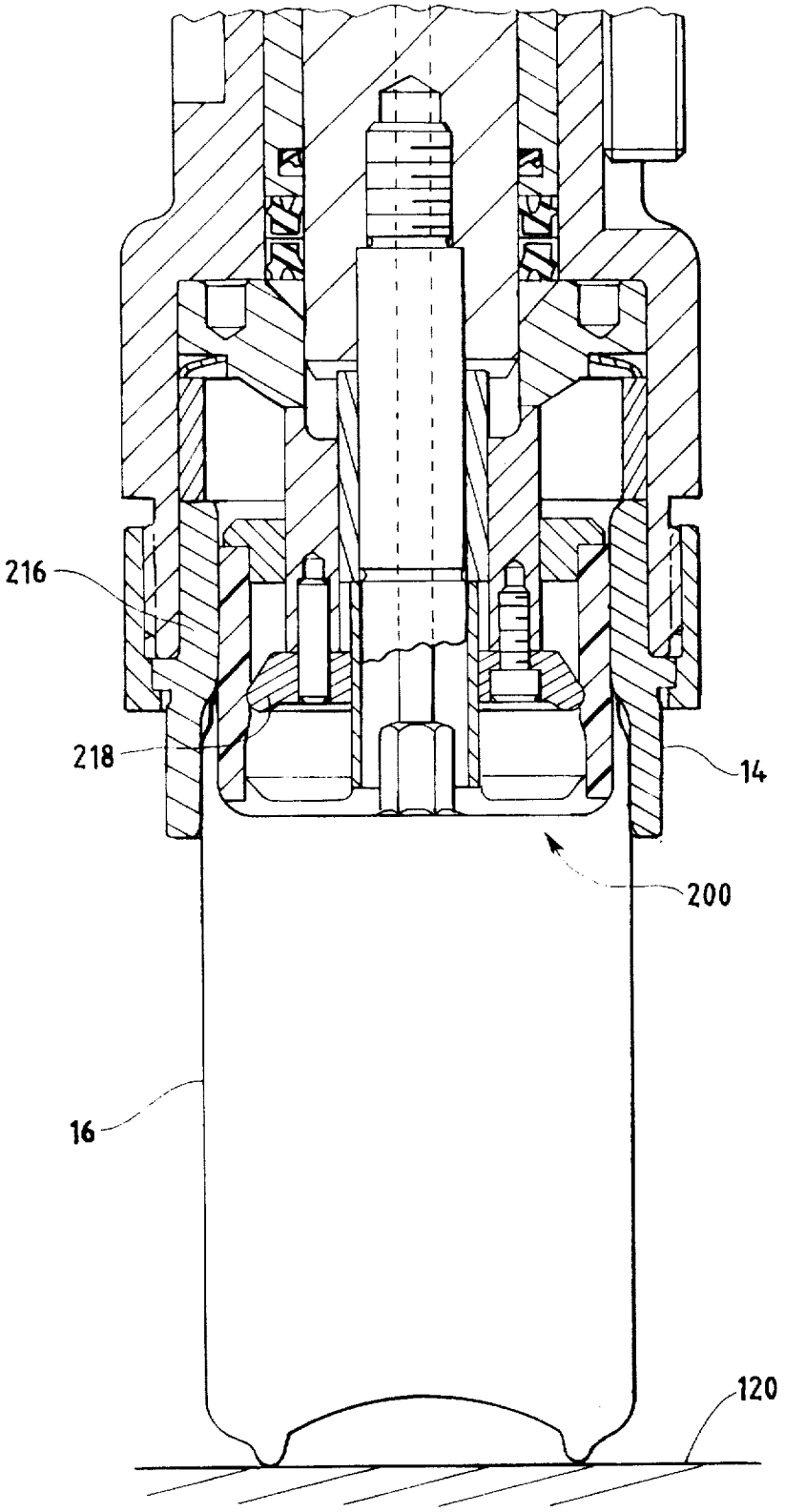
FIG. 7A is a cross-sectional view of the deformable support punch and die of FIGS. 3 and 5A, showing the upper region of the can being moved past the transition zone of the die with the actuator deforming the elastomeric sleeve so as to provide a supporting force against the can's inner surface during the necking operation.
Figure 7B:
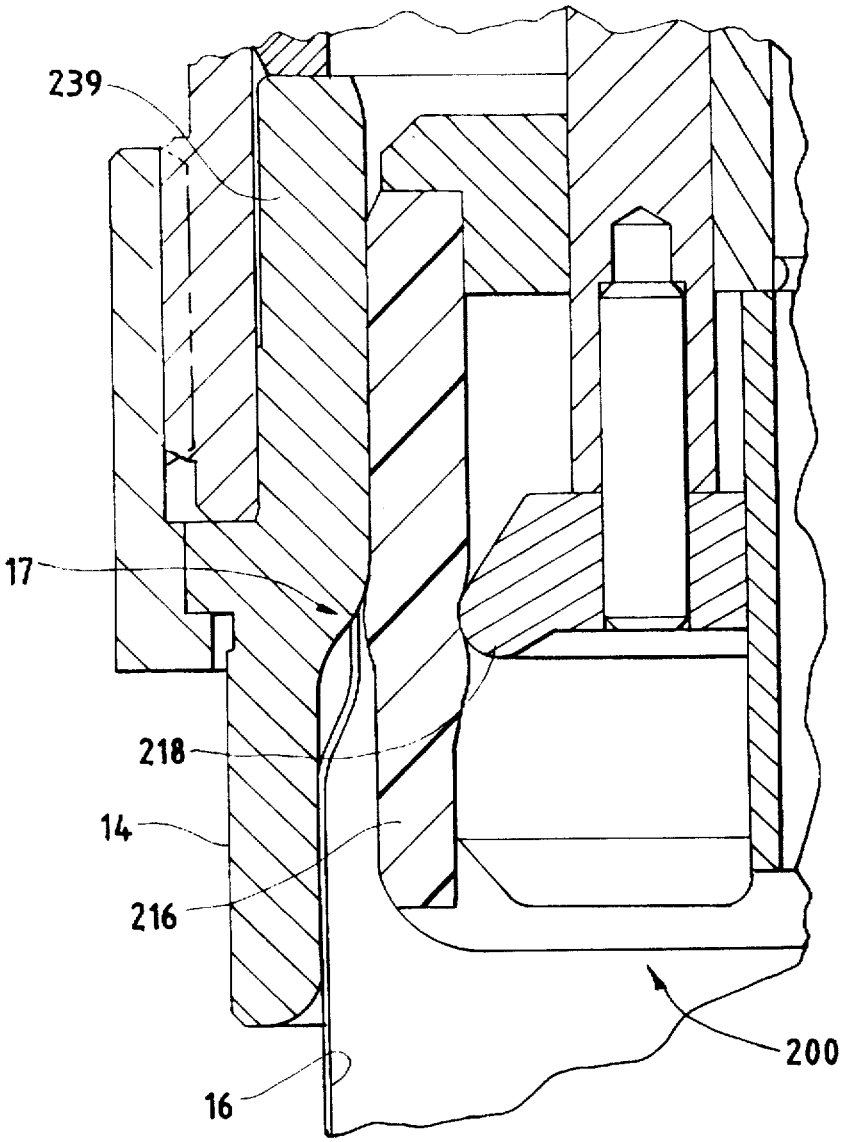
FIG. 7B is a cross-sectional view of a portion of the die and deformable support punch of FIG. 7A shown greatly enlarged.
Figure 8A:
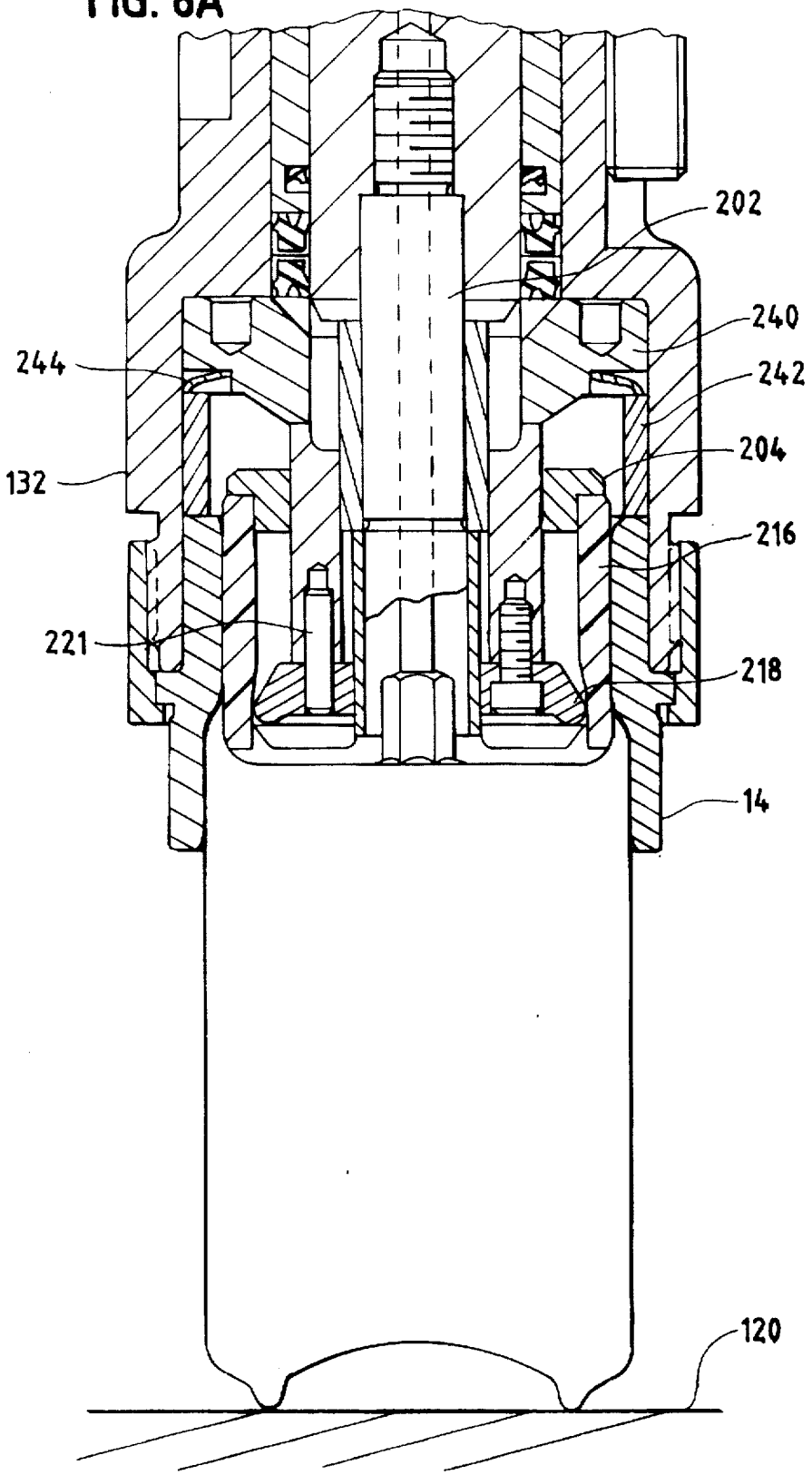
FIG. 8A is a detailed cross-sectional view of the deformable support punch and die of FIGS. 3 and 5A later in the necking operation of FIGS. 6 and 7, showing the upper region of the can fully inserted into the die, with the inside diameter of the sleeve providing a slight clearance relative to the extreme lateral edge of the actuator so as to allow the can to be readily removed from the die without interference between the sleeve and the can.
Figure 8B:
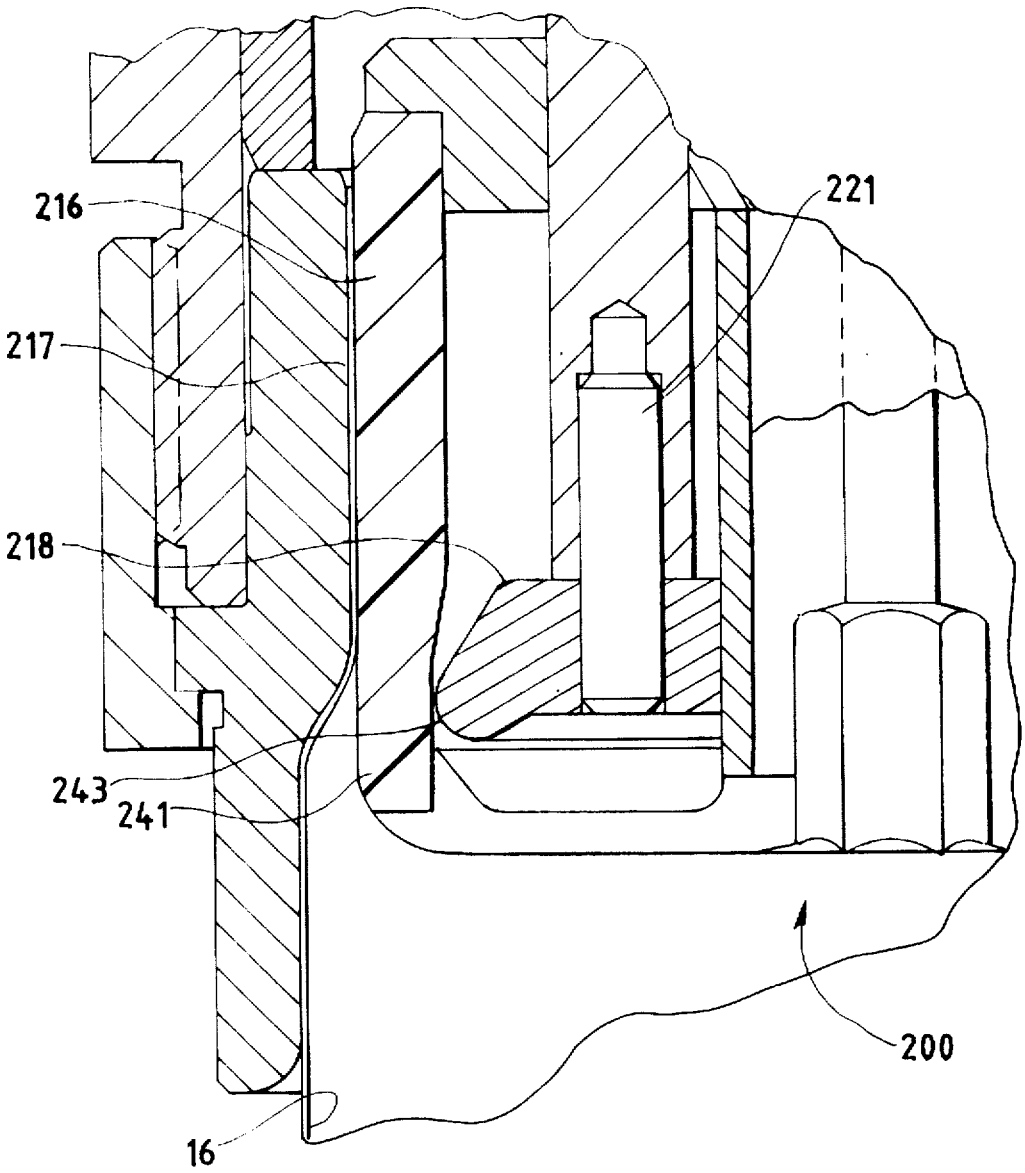
FIG. 8B is a cross-sectional view of a portion of the die and deformable support punch of FIG. 8A shown greatly enlarged.

FIG. 8A is a detailed cross-sectional view of the deformable support punch and die later in the necking operation of FIGS. 6A and 7A, showing the upper region of the can inserted into the die to the maximum extent as dictated by the upward travel of the support 120. The inside diameter of the sleeve 216 at the lower portion 241 thereof is equal to or slightly greater than the maximum diameter of the actuator 218, thereby providing a slight clearance between the medial surface 217 of the sleeve 216 and the extreme lateral edge 243 of the actuator 218. FIG. 8B is a cross-sectional view of a portion of punch of FIG. 8A greatly enlarged, showing this feature in further detail. This clearance prevents any lateral deformation in the sleeve 216, and allows the can to be readily removed from the die without interference between the sleeve 218 and the can 16.

It will be appreciated by those skilled in the art that FIGS. 5–8 describe the support features in single station in a necking operation, and that the support for the can is preferably incorporated into the deformable support punches for the other stations. Additionally, the invention may be used in a double neck or control neck type of necking arrangement.

Figure 8C:
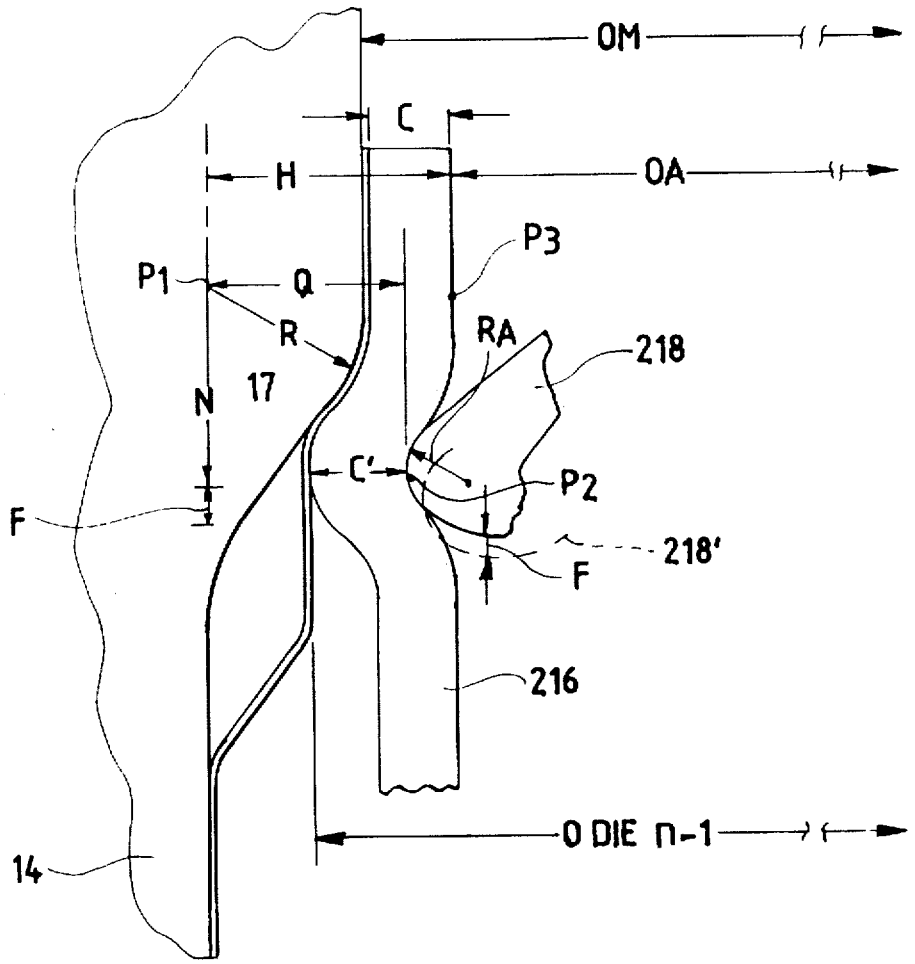
FIG. 8C is a schematic representation of the actuator, sleeve and die of the embodiment of FIG. 5.

Referring to FIG. 8C, in order to provide the proper support to the can opposite from the transition zone, the relationship between the position of the actuator 218 relative to the contour of the transition zone 17 of the die 14 is important. A presently preferred orientation is shown in FIG. 8C.

The following symbols in FIG. 8C are defined as follows:

ØE is the maximum diameter of the actuator 218 (which is the inside diameter of the sleeve 216 when expanded by interference).

ØM is the diameter of the upper or inner portion of the die above the transition zone 17.

C is the thickness of the sleeve 216.

ØA is the sleeve 218 inside diameter when not expanded.

$Ø_{Die\ n-1}$ is the exit diameter of the previous die (or the initial external diameter of an unnecked can.

The thickness of the sleeve 16 is chosen to be a reasonable value, and representative values for a 10 station necking system are set forth below in Table 1. The diameter ØE is chosen so that when expanded, the external diameter of the sleeve will be roughly equal to the can diameter: $Ø_{Die\ n-1}$+S, where S is the increase in diameter due to elastic spring back of the necked section of the can, and has a nominal value of 0.6 to 0.8 mm (0.0236 to 0.0315 inches) for 3018 aluminum alloy material at 135 μm thickness, and 0.2 to 0.3 mm for 3104 aluminum alloy material at 170 μm thickness.

When the sleeve is expanded, the thickness decreases according to the relationship $$C-C'=f(ØE-ØA)/2 \quad (1)$$

where C' is the modified thickness of the sleeve, and (ØE−ØA)/2 is the increase in radius. The coefficient f is a constant depending on the choice of hardness for the sleeve, with a value of about 0.22 for a 95 Shore A hardness sleeve and about 0.3 for a 90 Shore A hardness sleeve.

The diameter ØE is given by the following relationship:

$$ØE=Ø_{Die\ n-1}-2\ T_{topwall}-2C'+S \quad (2)$$

where T is the topwall thickness of the can. Combining Equations (1) and (2) yields the final result for the diameter of the actuator 218:

$$ØE=[Ø_{Die\ n-1}-2\ T_{topwall}-2C-fØA+S]/(1-f) \quad (3)$$

Still referring to FIG. 8C, The axial position of the actuator 218 relative to the center of curvature P1 of the die 14 is the sum of two quantities, N and F.

N would be the location of the actuator 218 so as to locate the maximal expanded sleeve diameter at the point where the necking starts, that is, where the can is reduced in diameter by contact with the transition zone 17 of the die. N is approximated as follows:

$$ØA=ØM-2T-C \quad (4)$$

$$H=(ØM-ØA)/2+R, \quad (5)$$

where R is the radius of curvature of the transition zone as shown in FIG. 8C; and $$Q=H-(ØE-ØA)/2=R+(ØM-ØE)/2 \quad (6)$$

The lateral profile of the deformed sleeve 216 follows the die radius R and describes an arc of a circle of radius R. One can assume that the internal profile of the deformed sleeve 216 is also an arc of a circle, with a radius H, the arc going from point P3 to the point P2, and hence the distance from P1 to P2 is also equal to the distance H. Thus, by elementary geometrical following relationship holds:

$$Q^2+N^2=H^2 \quad (7)$$

and hence $$N=(H^2-Q^2)^{1/2} \quad (8)$$

The assumption as to the ideal deformation for the elastomeric sleeve 216 does not completely reflect the actual shape of the sleeve in practice. This is also partly due to the actuator radius $R_A$ which introduces a deformation in the circle referred to above. The radius of curvature of the actuator $R_A$ has a value of 0.0787 inches in the illustrated embodiment.

Experiments have shown that better results are achieved by lowering the actuator 218 relative to the die by a small amount, the amount F in FIG. 8C, with the actuator in this lower position indicated by the dashed outline 218'. For the illustrated embodiment, a value of F of about 1 mm is preferred. Thus, the total vertical distance between the actuator's radius center and the die entry radius center is preferably the quantity N+F as illustrated in FIG. 8C.

The thicknesses of the sleeve C for a preferred representative ten-station necking operation are as follows:

TABLE 1

| Station | Thickness of sleeve (in inches) |
|---|---|
| 1 | 0.265 |
| 2 | 0.250 |
| 3 | 0.225 |
| 4 | 0.200 |
| 5 | 0.187 |
| 6 | 0.187 |
| 7 | 0.187 |
| 8 | 0.182 |
| 9 | 0.182 |
| 10 | 0.182 |

The necking station described above is preferably designed to be operated at high speed and for prolonged periods of time between maintenance and service. The material selected for the sleeve 216 contributes to the performance of the station, and the selection of the sleeve material and its hardness is important. The principal criteria are that the sleeve 216 must apply a clamping or supporting force on the can to press the can against the diameter during the reduction in diameter, expand repeatedly and largely without permanent deformation, and slide relative to the actuator 218 without undue friction and wear. A preferred material meeting these criteria is ADIPRENE® PP1048, a product of Uniroyal Chemical Co., which is a urethane polymer with a durometer hardness rating of 95 Shore A, with 3% primax and 2.5% self lube. An alternative embodiment for the sleeve 216 material is ADIPRENE® L 167, also a product of Uniroyal Chemical Co., which is a liquid urethane polymer cured into a strong rubbery solid by reaction of the isocyanate groups with polyamine or polyol compounds and cured with 4,4'-methylelene-bis [2-chloraniline] to a hardness rating of 95 Shore A. Although polyurethane materials have a relatively low coefficient of friction in this hardness range, the friction can be further reduced by impregnating the sleeve with self-lubricating treatments, creating a lubricative device between the actuator 218 and the sleeve 216. Preferably, the actuator 218 is given a TEFLON® or other low friction coating.

The choice of hardness for the sleeve 216 is dictated by the need for wear resistance and magnitude of the required clamping force to apply on the necked area, which is a function of the thickness of the can wall, the can material, and the amount of diameter reduction in the station. A hardness rating of at least 60 Shore A, and preferably at least 90 Shore A may be sufficient, but would not be as good as 95 Shore A, but 90 Shore A may be acceptable for 160 μm thick aluminum beverage cans. The hardness may also depend on the number of necking stations and the modulus and thickness of the container wall.

Alternative Deformable Support Punch Embodiment With Squeezable Material Pressed Into Lateral Expansion by Fluid Pressure There are many possible alternative embodiments to the deformable support punch design described in FIGS. 5–8 in which the lateral deformation of an elastomeric sleeve may be achieved by other means, such as by compression of the sleeve from a relaxed state to a laterally deformed state, as described below. The compression of the sleeve is achieved by pressurizing the interior of the can after it has been inserted into the die with a fluid (e.g., air). The air acts either directly or indirectly to compress the elastomeric material, wherein the elastomeric material is deformed laterally in the compressed state so as to provide the supporting force to the interior wall of the can against the die. When the upper portion of the can has been fully inserted into the die, the fluid pressure is removed and the elastomeric material resumes its relaxed, normal state, enabling the can to be readily ejected from the die.

Figure 9:
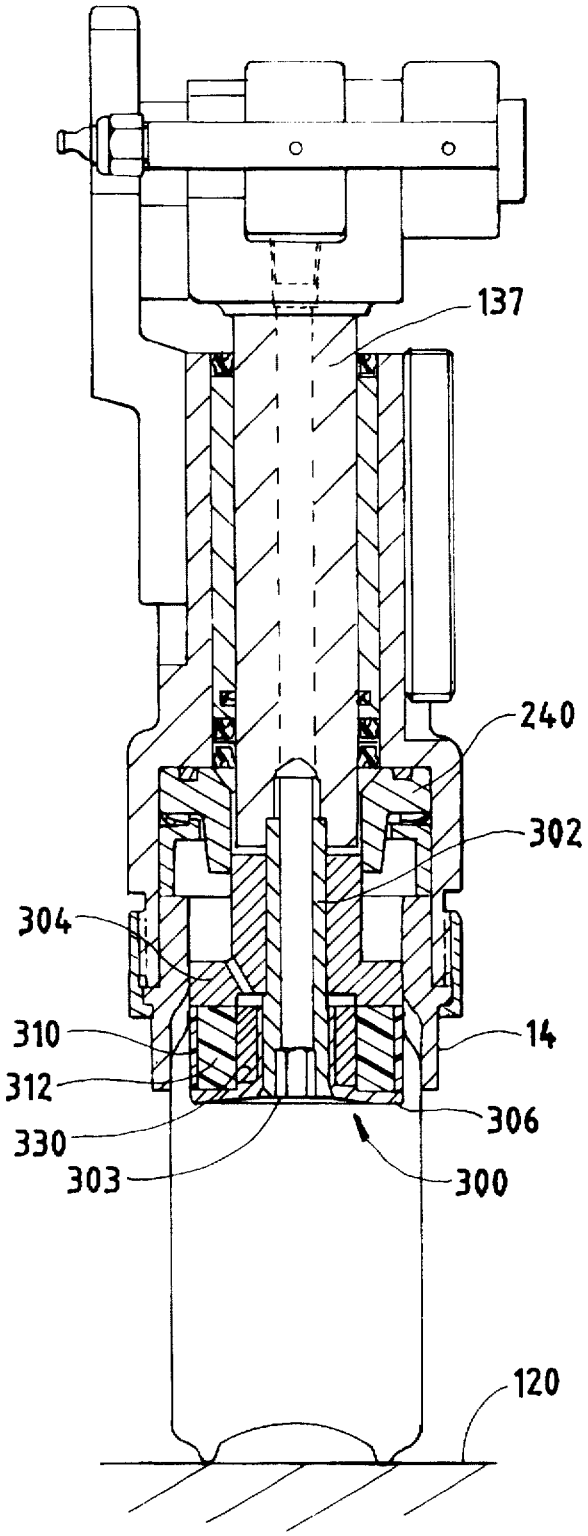
FIG. 9 is a cross-sectional view of an alternative embodiment of the deformable support punch of FIGS. 5–8.

An embodiment is shown in cross-section in FIG. 9. The details of the die and main rod 137 are basically the same as the embodiment of FIGS. 5–8. The difference is the construction of the deformable support punch 300, which is based on a dual durometer elastomeric assembly having a elastomeric sleeve 310 and a inner concentric cylindrically shaped elastomeric block 312. The supporting features provided by an elastomeric sleeve 310 against the can wall opposite the transition zone of the die 14 are shown in greater detail in FIG. 10B.

Like the deformable support punch 200 of FIG. 5, the punch 300 of FIG. 9 also reciprocates within the main guide 240 between upper and lower positions. The punch 300 includes a center guide rod 302 with a central bore 303 and a carbide sleeve 304. The center guide rod 302 further has a lower piston 306 that is moveable axially relative to the center guide rod 302. The central bore 303 allows compressed fluid (e.g., air) to be directed into the can from a conventional source of compressed air.

The deformable elastomeric material in the embodiment of FIG. 9 comprises a outer cylindrically shaped elastomeric sleeve 310 bonded to a concentrically disposed, cylindrically shaped elastomeric block 312. The elastomeric materials 310 and 312 are constrained medially by the cylindrical wall 305 of the center guide rod 302 (see FIG. 10A), and constrained axially above by the carbide sleeve 304 and below by the piston 306.

The elastomeric sleeve 310 and the inner cylindrical block 312 are made from materials of differing hardness, and their relative thickness in the radial direction is also different, as shown in FIG. 9. The hardness rating of the inner cylindrical block 312 is substantially less than the hardness rating of the outer cylindrical sleeve 310, and the thickness in the radial direction is substantially greater than the thickness of the sleeve 310. These features promote a lateral expansion of said outer cylindrical sleeve 310 when pressurized air is introduced into said can causing the piston 306 to squeeze the members 310, 312. Since the outer sleeve 310 is the elastomeric component that makes direct contact with the can wall and must transmit the supporting forces on the can wall, it is preferably made from an elastomeric material with a hardness rating of at least 60 Shore A, and preferably greater than 90 Shore A, with ADIPRENE® PP 1048 polyurethane with a durometer hardness rating of 95 Shore A being preferred for the illustrated beverage can embodiment. The inner cylindrical elastomeric block 312 is preferably made from a softer material such that when the pressurized air imparts forces normal to the surface of the piston 306, the block 312 is readily compressed. We prefer to use a material with a harness rating of less than 40 Shore A for block 312, and polyurethane with a hardness rating of 30 Shore A is a preferred embodiment. The remarks made above regarding the relationship between the hardness of the sleeve 216 and the amount of diameter reduction and can wall thickness apply also to the selection of the material for the outer sleeve 310.

Figure 10A:
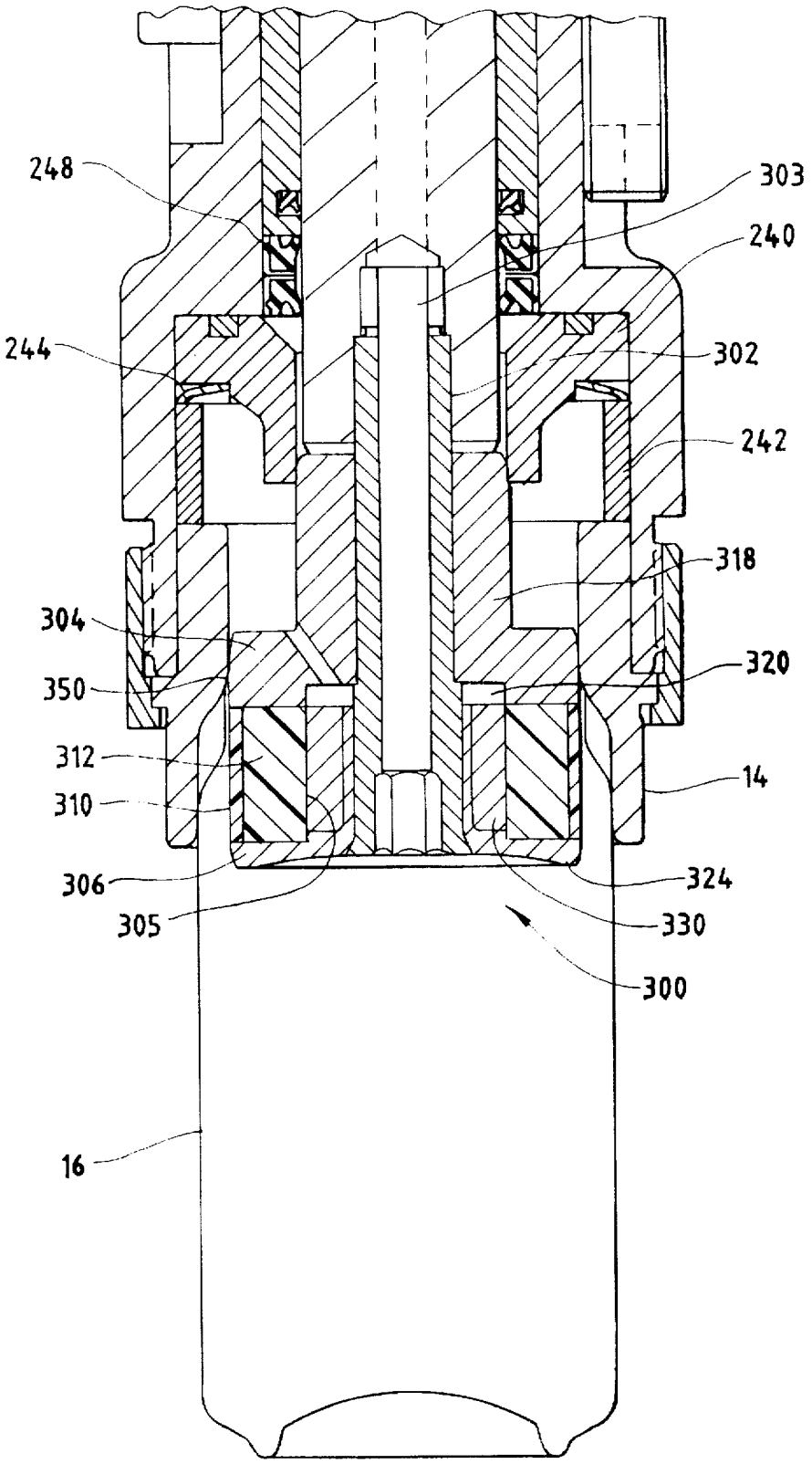
FIG. 10A is a cross-sectional view of the deformable support punch and die of FIG. 9 when the can is inserted into the die to the point where the upper edge of the can makes initial contact with the transition zone of the die.

Referring to FIGS. 9 and 10A, the medial portion 318 of the carbide sleeve 304 is given an annular recess 320 so as to provide clearance for an upstanding portion of the piston 306 to move into the recess 320 during compression of the blocks 310. The lateral deformation of the block 312 contributes to and assists a lateral deformation of the sleeve 310, causing the sleeve to be pressed into engagement with the interior wall of the upper portion of the can as the upper portion can is moved past the die 14. The surface area of the head 324 of the piston 306 is considerably greater than the portion of the block 312 placed above the head 324, giving a mechanical advantage when the compressed air is introduced into the can.

Since the deformable support punch 300 of FIG. 9 is also designed to be operated at high speed, the ability to compress the elastomeric materials 310 and 312 quickly with the usual amount of air pressure injected into the can (e.g., 35 p.s.i.) is important. The mass of the piston 306 is therefore reduced where convenient to promote quick upward acceleration of the upstanding portion of the piston 306 into the recess 320. Accordingly, the piston 306 itself, or at least a substantial portion thereof, is preferably made from a light weight material such as aluminum. In the embodiment of FIG. 9, the portion 330 that constrains the block 312 in the medial direction is made from aluminum while the rest of the piston is made from steel.

Figure 10B:
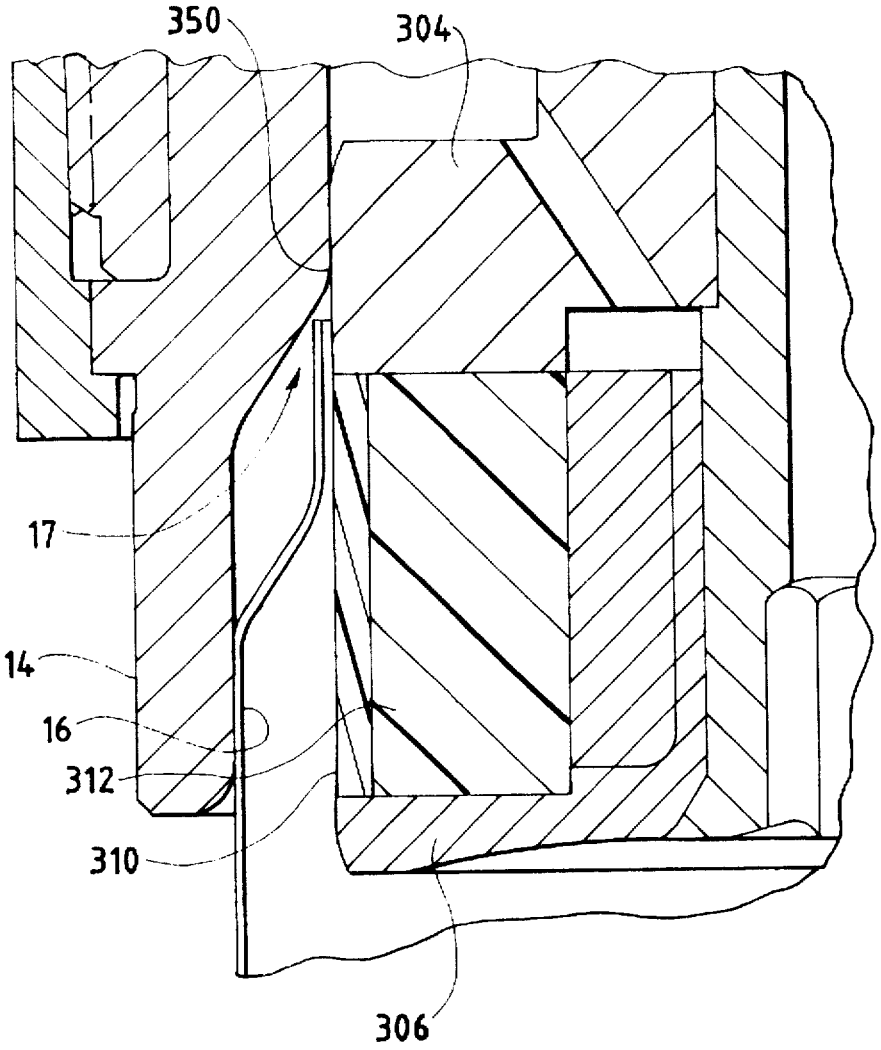
FIG. 10B is a cross-sectional view of a portion of the die and deformable support punch of FIG. 10A shown greatly enlarged.

With the above description in mind, the embodiment of FIG. 9 will now be discussed in conjunction with a representative necking operation. FIG. 10A is a cross-sectional view of the deformable support punch 300 and die 14 of FIG. 9 showing their relative position when a can 16 is inserted into the die to the point where the upper edge of the can makes initial contact with the transition zone of the die 14. At this point, the elastomeric assembly 310, 312 and the rest of the punch 300 are at their lower point in their travel. To help preserve the life expectancy of the sleeve 310, the top edge of the can 16 makes initial contact with the lateral surface 350 of the carbide sleeve 304. Since this is a potential wear point, the sleeve is given an extremely hard, low friction surface coating, e.g., a Diamonex® diamond coating. FIG. 10B is a cross-sectional view of a portion of the die and punch of FIG. 10A in the vicinity of the transition zone shown greatly enlarged, showing the contact between the top edge of the can 16 and the die 14, with the sleeve 310 placed within the can 16.

Figure 10C:
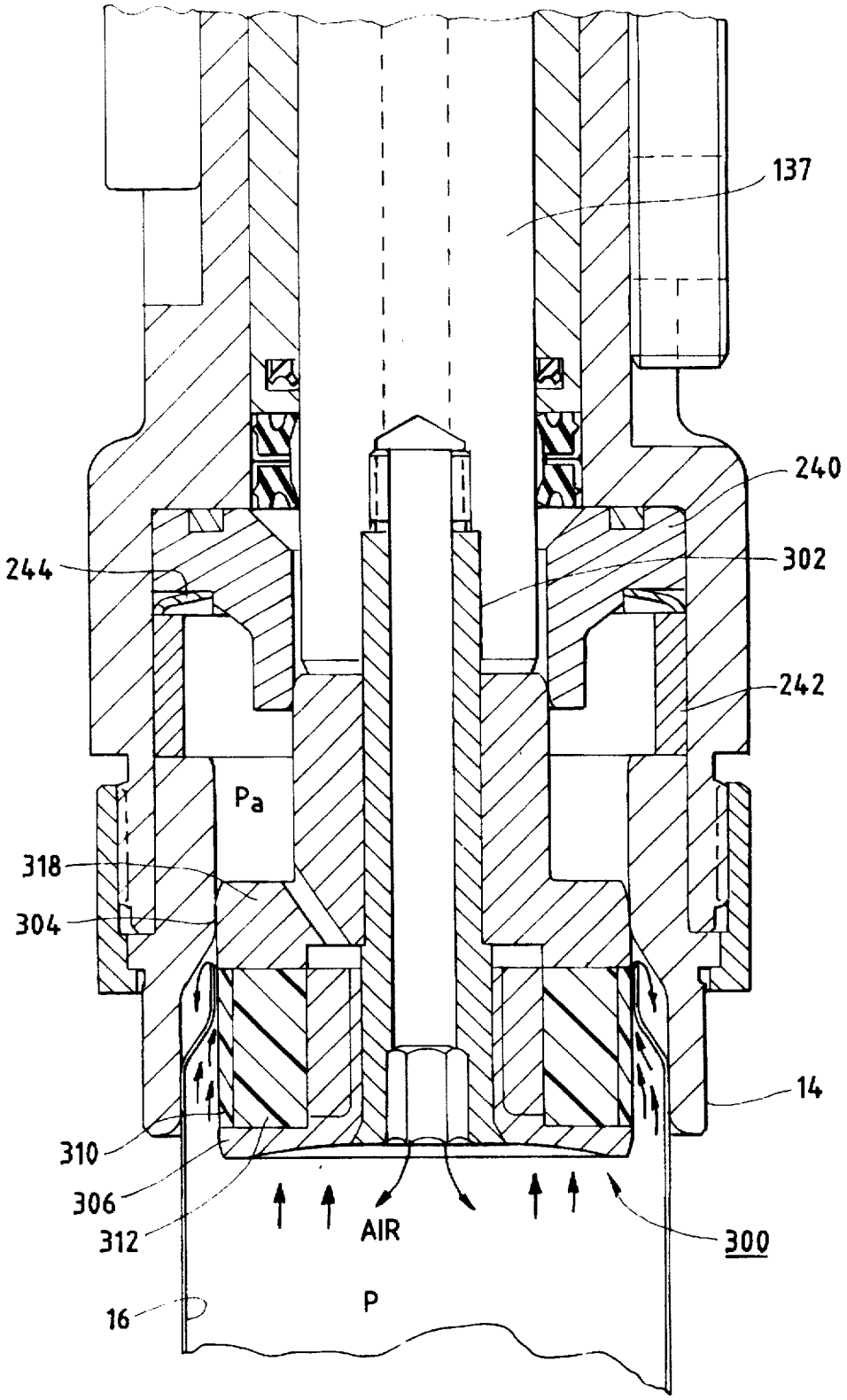
FIG. 10C is a cross-sectional view of the deformable support punch of FIG. 10A early in the necking cycle, showing the air pressure forces acting on the punch.

FIG. 10C is a cross-section view of the deformable support punch 300 and die of FIGS. 9 and 10A at an early stage of the necking cycle. At the start of the cycle, the air pressure P inside of the can 16 becomes higher than the ambient pressure because the pressure drops when air flows across the narrow gap formed between the outside diameter of the elastic sleeve 310 and the inside diameter of can 16. The pressure difference causes the lower position 306 to move upward to compress the elastic sleeve 310 and elastic block 312. The action continues until the sleeve 310 contacts the inside diameter of can 16. The contact between the sleeve 310 and the can acts to seal the interior of the can when air is injected into the can. While can 16 is pressurized to pressure P (e.g., 35 p.s.i.), the area above the carbide sleeve 318 is maintained at atmospheric pressure Pa, with the pressure differential providing the ability of the piston 306 to compress the block 312 and sleeve 310.

Figure 11A:
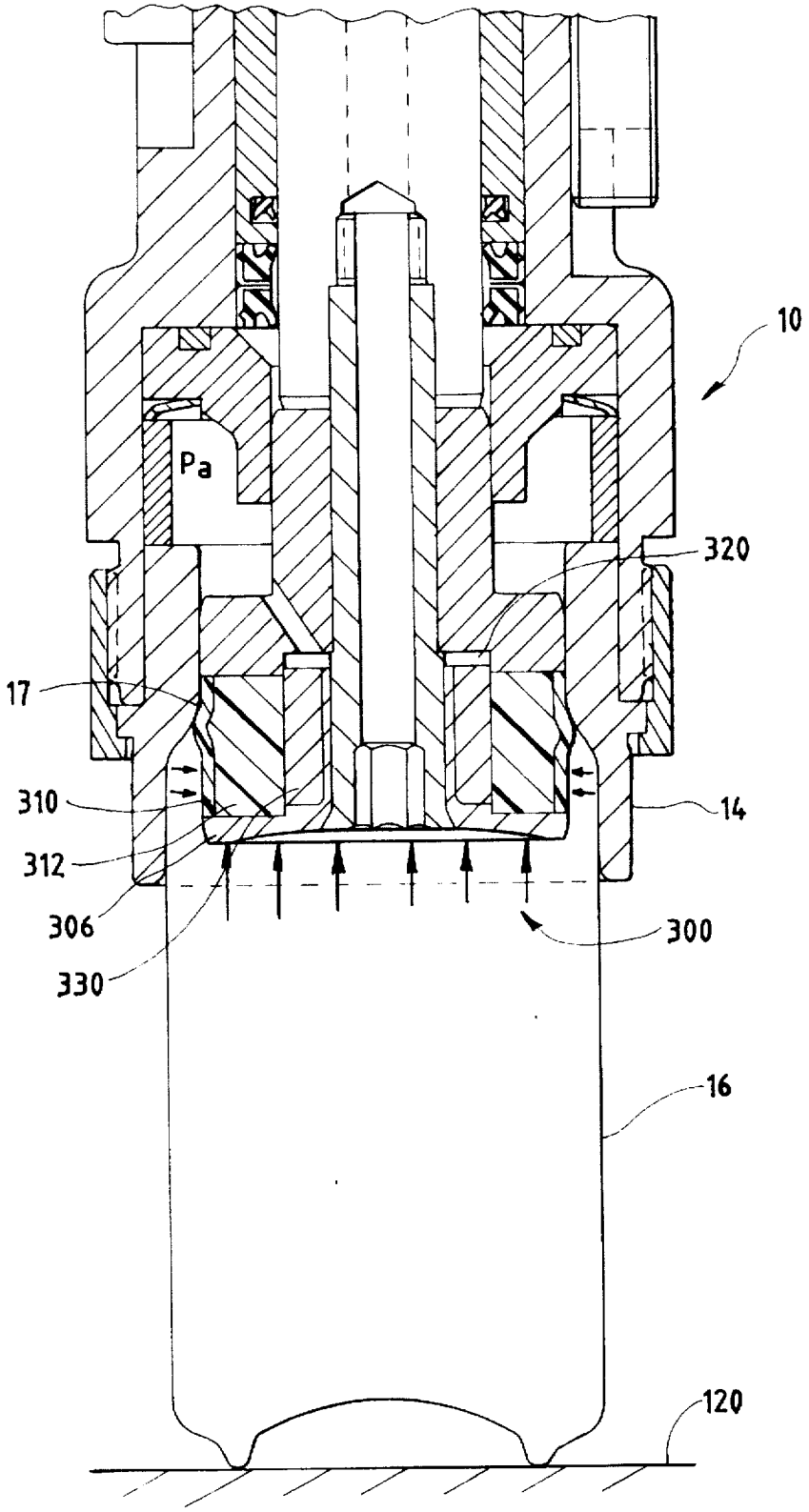
FIG. 11A is a cross-sectional view of the punch and die of FIG. 9, showing a portion of the upper region of the can being moved past the transition zone of the die with the dual durometer assembly compressed by the piston due to air injected into the can to deform the assembly laterally so as to provide a supporting force against the inner surface of the upper region of the can during the necking operation.

FIG. 11A is a cross-sectional view of the deformable support punch and die of FIGS. 9 and 10A later in the necking cycle. The punch 300 has moved up at approximately the same rate and distance as the can 16 as compared to FIG. 10A. Due to the relative motion between the can 16 and the die 14, a portion of the upper region of the can 16 is moved past the transition zone 17 of the die 14 in the necking operation. The air in the can causes the dual durometer actuator assembly 310, 312 to be compressed by the piston 306 due to normal forces on the surface of the piston 306 (represented by the arrows). The assembly 310, 312 is deformed laterally due to the upper, lower and medial constraints on the elastomeric material, with the sleeve 310 supporting the inner surface of the upper region of the can 16 during the necking operation. The portion of the can 16 that is above the transition zone in the reduced diameter region of the die is supported by the upper portion of the sleeve 310 which is also now above the transition zone 17, in the manner described in the Caleffi et al. patent.

Figure 11B:
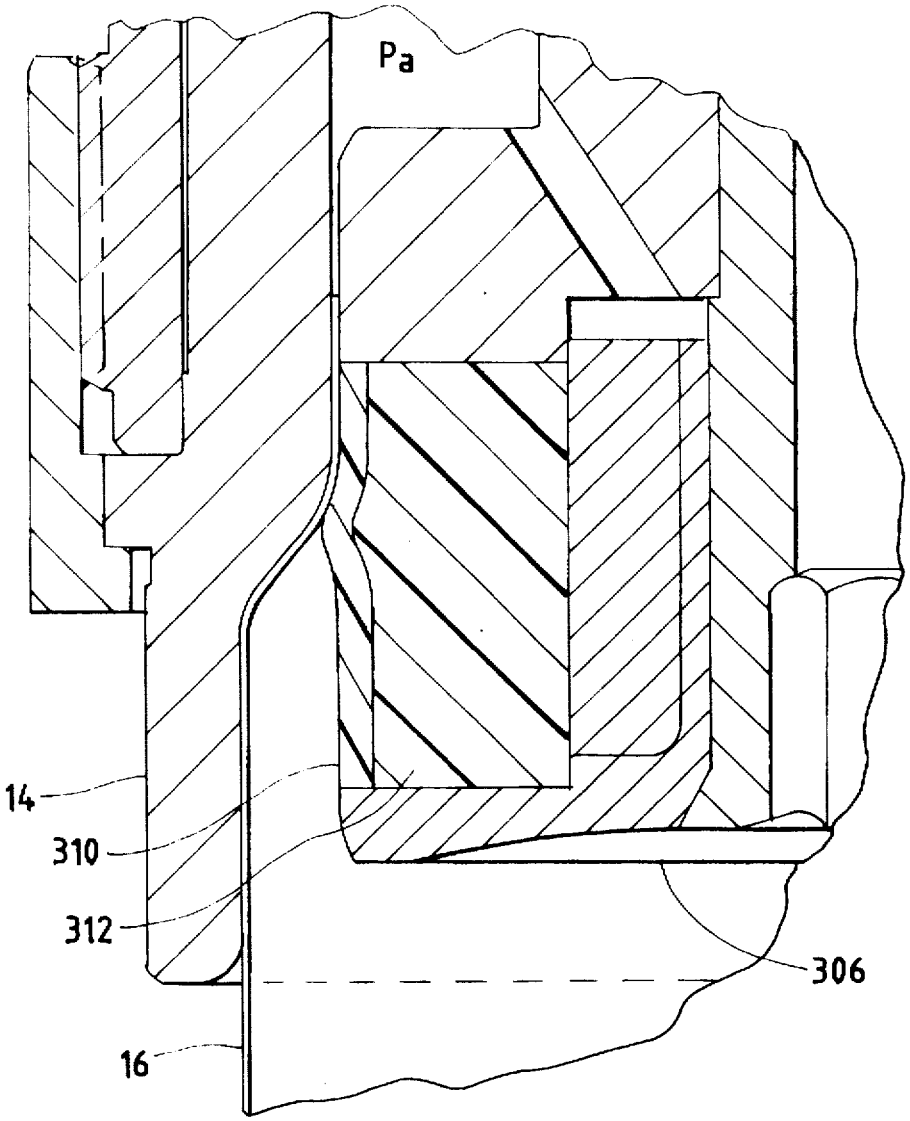
FIG. 11B is a cross-sectional view of a portion of the die and punch of FIG. 11A shown greatly enlarged.

The cams for the station 10 (FIG. 2) are designed such that the deformable support punch and dual durometer assembly 310, 312 move upwards into the die 14 with the can 16 at substantially the same velocity to prevent substantial friction between the can 16 and the sleeve 310. As shown in FIG. 11B, the sleeve 312 is deformed laterally into contact with the interior surface of the can into supporting engagement with the interior wall of the can as the upper region of the can is moved past the transition zone of the die to reduce the diameter of the upper region of the can.

Figure 12A:
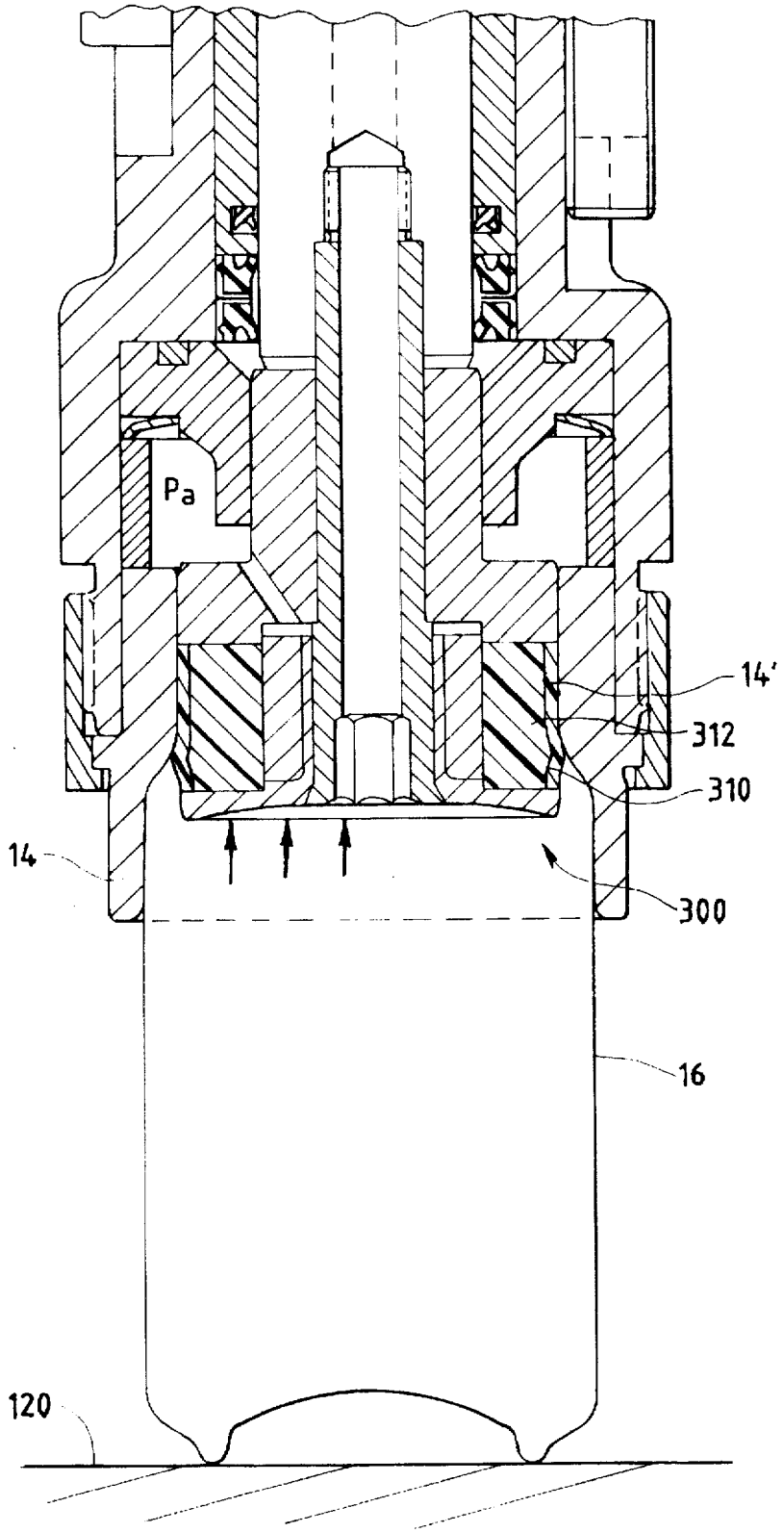
FIG. 12A is a detailed cross-sectional view of the punch and die of FIG. 9 later in the necking operation of FIGS. 10 and 11, showing the can fully inserted into the die.
Figure 12B:
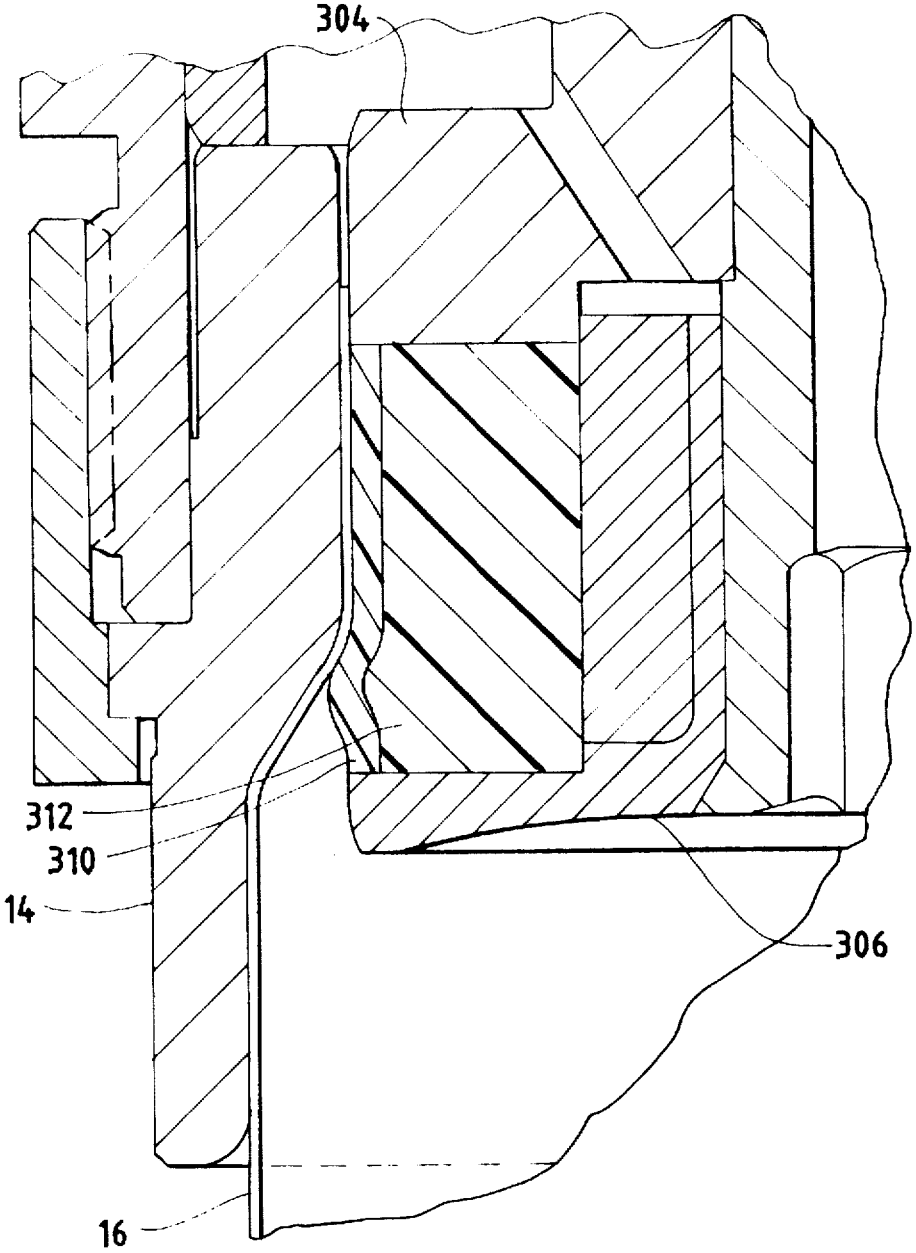
FIG. 12B is a cross-sectional view of a portion of the die and deformable support punch of FIG. 12A shown greatly enlarged.

FIG. 12A is a detailed cross-sectional view of the deformable support punch and die of FIG. 9 later in the necking operation of FIGS. 10 and 11, showing the upper region of the can 16 fully inserted into the upper reduced diameter surface of the die 14'. FIG. 12B is a cross-sectional view of a portion of the die and punch of FIG. 12A shown greatly enlarged. At the top of the stroke, an air bleed from the punch 300 begins. As the can and lower support move down in the downstroke, the air bleed continues such that the dual durometer assembly 310, 312 relaxes to its normal or relaxed state with substantially no lateral deformation. The can is readily removed from the die 14.

Figure 13A:
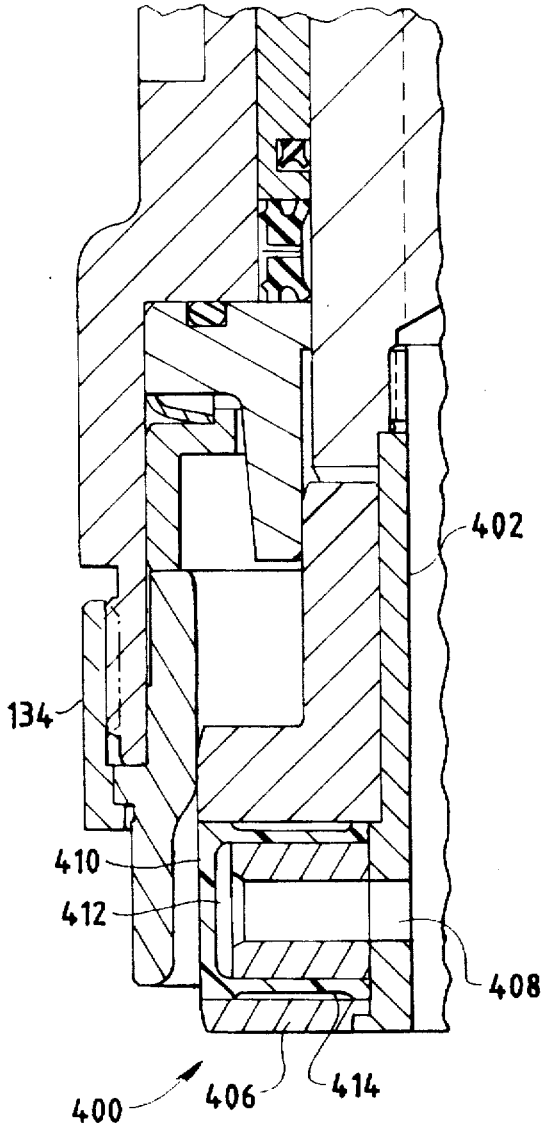
FIGS. 13A and 13B are cross-sectional views of alternative embodiments similar to the embodiment of FIGS. 9–12, with the deformable support punch in its lower position.
Figure 13B:
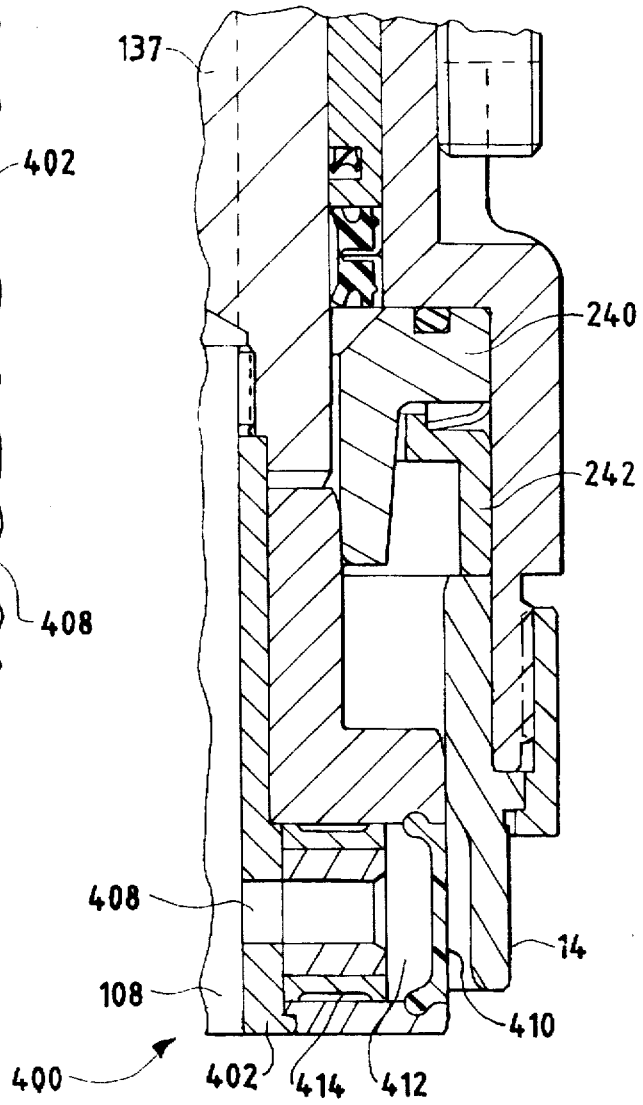

FIGS. 13A and 13B are cross-sectional views of alternative embodiments similar to the embodiment of FIGS. 9–12, with a deformable support punch 400 in its lower position. The punch 400 has an elastomeric sleeve 410 that is used to support the can wall during the necking operation, as described above. The lateral deformation of the sleeve is assisted by a piston 406 positioned at the bottom of the punch 400, and air passages 408 in the guide rod 402 that lead to a circumferential circular air section 412 pressing against the medial surface of the sleeve 410. When air is introduced into the passages 408, the normal forces on the lower surface of the piston 406 force the piston to move upward and compress an elastomeric band 414 and the sleeve 410. Meanwhile, lateral forces are imparted on the elastomeric sleeve 410 to be deformed laterally into supporting engagement with the can.

The air introduced into the air section 408 provides additional force to expand the elastic sleeve 410 radially and enhance contact of the sleeve 410 for supporting the inside of the can. This is a beneficial feature especially at the beginning of necking cycle to provide a sufficient seal between can and sleeve 410.

Figure 13C:
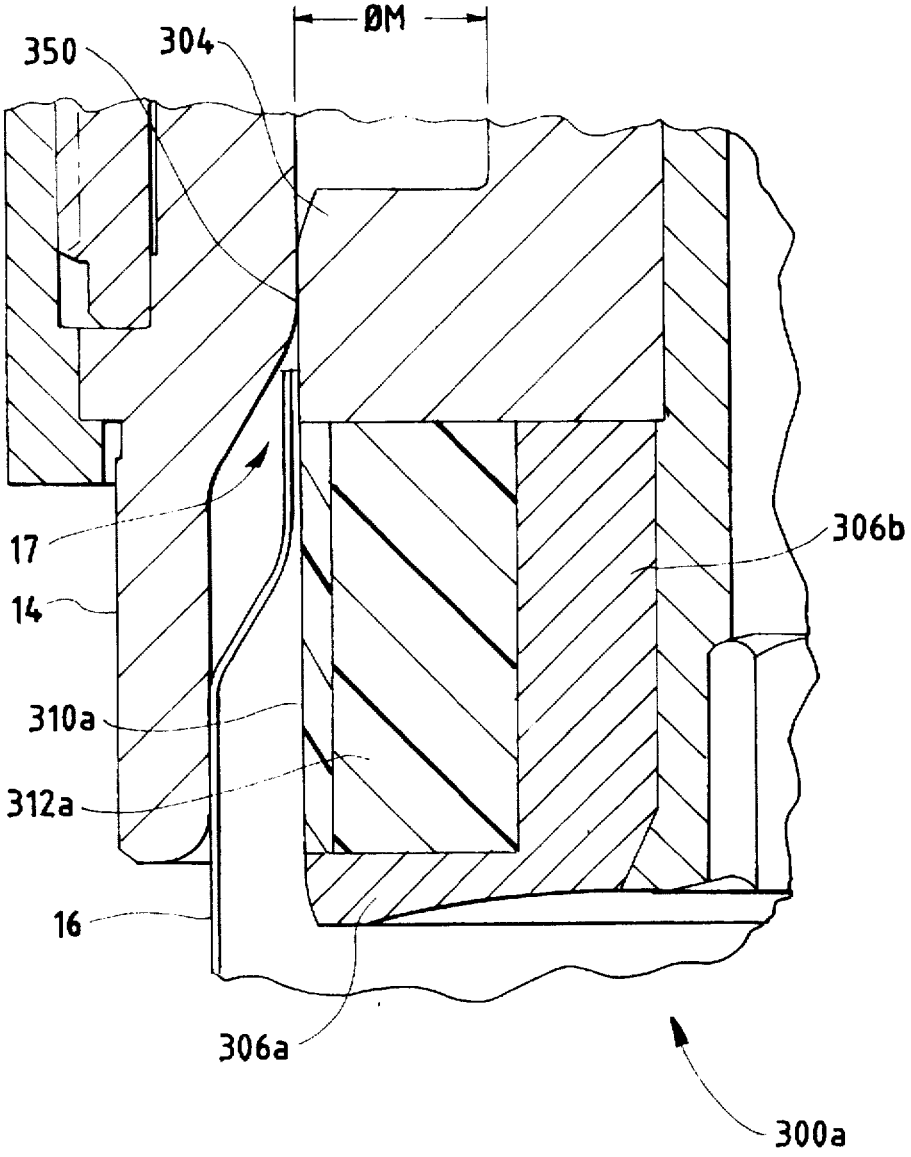
FIG. 13C is a cross-sectional view of an alternative embodiment of the invention in which the elastomeric sleeve is given a diameter greater than the diameter of the inner portion of the die, resulting in the sleeve providing supporting forces against the can when the sleeve is withdrawn further into the die such that the sleeve makes an interference with the inside of the can when the can and sleeve are moved further into the die.

FIG. 13C is a cross-section of yet another embodiment of the invention. The deformable support punch 300A has an elastomeric sleeve 310A forming a lateral surface extending circumferentially around the periphery of the punch 300A. The punch 300A has an inner concentric cylindrical block 312A also made from an elastomeric material. Upper and lower axial restraints are provided by the carbide sleeve 304 and the lower member 306. The upstanding portion 306B acts as a medial restraints on the elastomeric materials. The elastomeric sleeve 310A has a diameter greater than the diameter ØM of the inner portion of the annular necking die 14 minus twice the can neck wall thickness. Relative axial movement between said elastomeric material 310A and the die 14 such that the elastomeric material and can are inserted into the die 14 promotes an interference between the elastomeric material 310A and the can to thereby provide supporting forces to the can as the can is moved past the transition zone to reduce the diameter thereof.

Persons skilled in the art will recognize that a deformable support punch 300A may replace the solid punches known in the prior art.

Note further that the carbide sleeve 304A does not have recesses to accommodate the upper portion of member 306A, thus member 306A is stationary (and does not act as a piston) and the deformation in the sleeve is introduced by the interference between the larger diameter sleeve 310A and the inside wall of the can 16. Though the embodiment of FIG. 13C is considered less desirable than the other embodiments described herein, since it is without benefit of a lateral expansion of the elastomeric material due to compression, the interference between the sleeve 310A and the can 16 is capable of providing the support in the neck and transition region of the can 16.

Figure 13D:
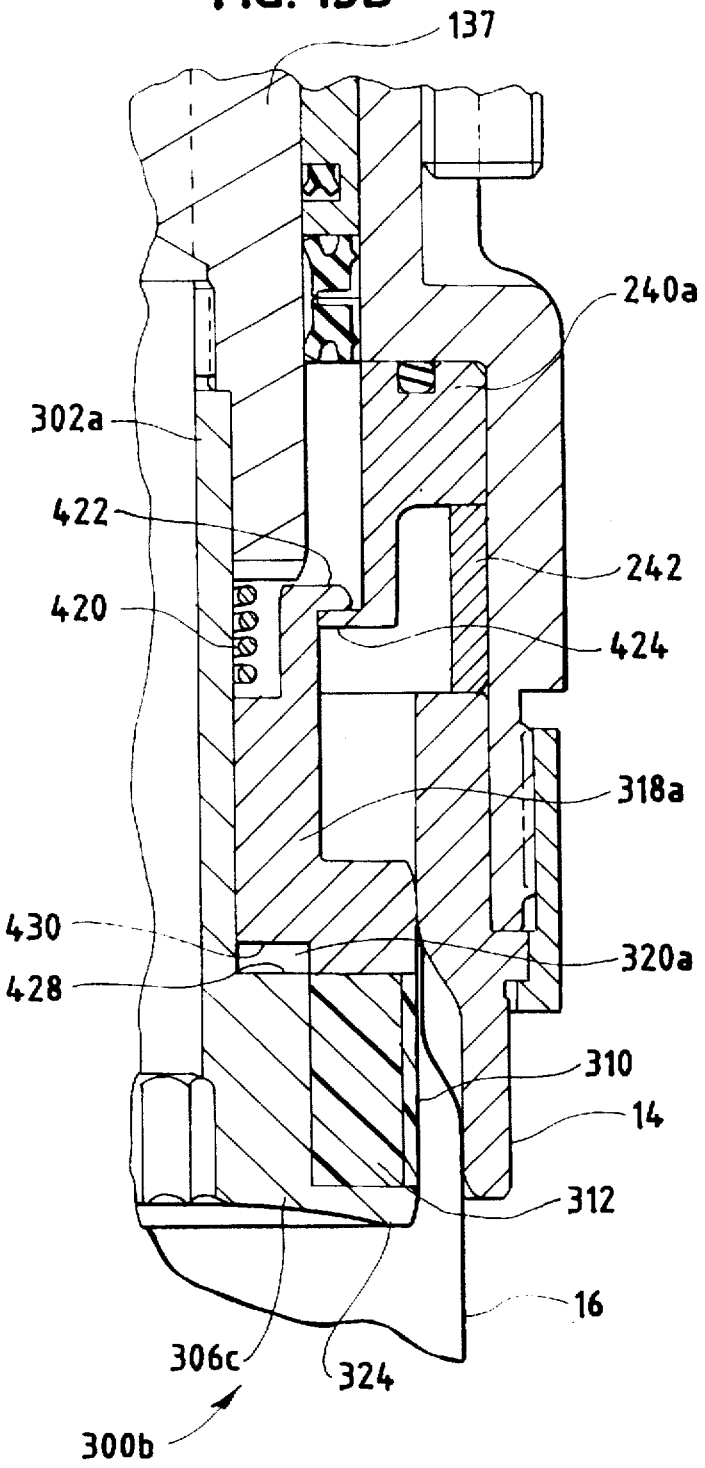
FIG. 13D is a cross-sectional view of an alternative embodiment in which mechanical forces are applied to the carbide sleeve to compress the elastomeric sleeve to provide the support for the can.

FIG. 13D is a cross-sectional view of another embodiment of a deformable support punch 300B in accordance with the invention in which mechanical means such as a spring is used to generate compressive forces for expanding the deformable elastomeric sleeve 310 and elastomeric block 312 laterally into supporting engagement with the can 16. The punch 300B has a coil spring 420 attached at one end to a carbide sleeve 318A and the other end attached to the lower surface of the rod 137. The outer lip 422 of the carbide sleeve 318A rests on a rim 424 of the annular main guide 240A when the punch 300B is in the lowest position, as shown.

When the rod 137 and the center guide rod 302A with integral piston portion 306C are moved upwards in the necking cycle, the coil spring 420 is stretched and expands from its compressed state. This stretching of the spring 420 imparts downward forces on the upper surface of the carbide sleeve 318A, causing the carbide sleeve 318A to stay at approximately the same location relative to the die 14 while the shoulder portion 428 of the piston 306C moves upward into an annular gap 320A. The relative motion of the piston 306C and the carbide sleeve 318A compresses the elastomeric block 312 and elastomeric sleeve 310 laterally, into a supporting engagement with the interior surface of the can 16.

After the upper shoulder portion 428 of the piston 306C completely occupies the annular recess 320A and butts against the surface 430 of the carbide sleeve 318A, the whole assembly 318A and 302A/306C move upward together as the rod 137 moves upward. This action continues to deform the elastomeric block 312 and elastomeric sleeve 310 laterally into a supporting engagement with the can in the manner described above in conjunction with the other embodiments. When the punch 300B is at the top of the stroke, the coil spring 420 acts again to move the piston 306C downward into the original extended position relative to the carbide sleeve 318A, resulting in the elastomeric materials 310, 312 returning to a relaxed state.

Persons of skill in the art will recognize that this embodiment is but one possible example of the use of resistance forces to cause a lateral expansion or deformation of an elastomeric material to achieve the beneficial support features provided by the invention. Those skilled in the art will appreciate that variations may be made to this embodiment and not depart from the essential teachings herein.

Figure 14:
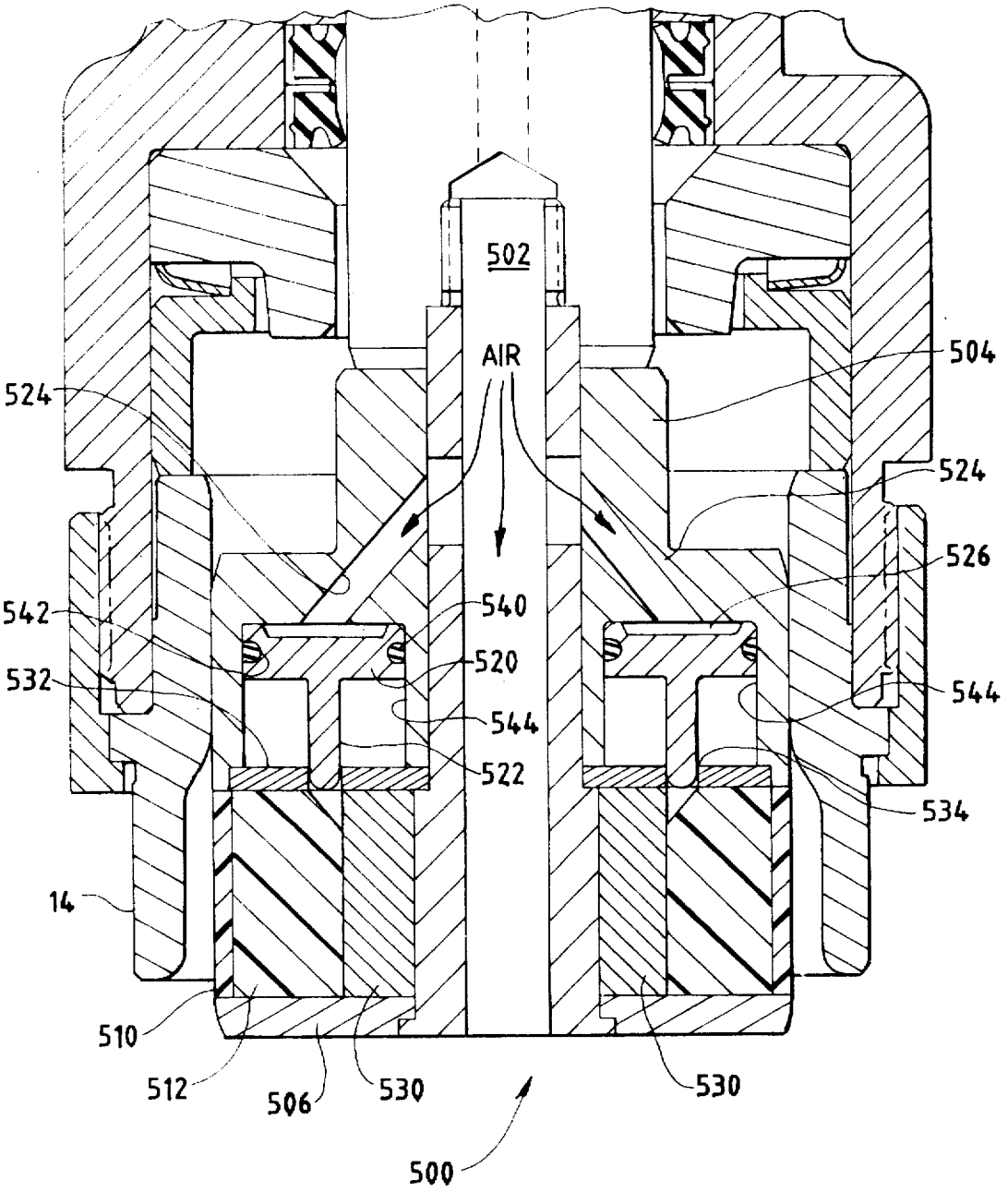
FIG. 14 is a cross sectional view of yet another embodiment of the invention, showing an insert in the deformable support punch which provides an additional mechanical advantage in deforming the inner concentric cylindrical elastomeric block.

FIG. 14 is a cross sectional view of yet another embodiment of the invention. The deformable support punch 500 has a guide rod 502, a piston 506, an inner elastomeric cylindrically shaped block 512 and an outer elastomeric sleeve 510. The medial constraint on the block 512 is an aluminum cylinder 530. A plate 532 constrains the block 512 from above. The punch 500 has an insert 520 which provides an additional mechanical advantage in deforming the inner concentric cylindrical elastomeric block. The insert 520 is positioned within the carbide sleeve 504 and has a circular projecting portion 522. Air passages 524 are provided in the carbide sleeve 504 and the guide 502. When compressed air is introduced into the main guide 137, the air passes through the passages 524 and presses against the upper surface 526 of the insert 520, causing the projecting portion 522 to move downward into the gap 534 in the plate 532 and into contact with the elastomeric block 512. The projecting portion applies a compressive force to the cylindrical block 512, and cooperates with the upward compressive forces provided by the piston 506 to compress the cylindrical block 512 and induce a lateral deformation in the sleeve 510. When the air pressure is released from the can, the block 512 returns to its relaxed state and the projecting portion 522 no longer exerts compression forces onto the block 512. O-ring seals 540 and 542 make a tight seal with the side walls 544 of the sleeve 504.

The embodiments of FIGS. 9, 13A, 13B and 14 all share a common feature by which the elastomeric sleeve is deformed laterally only when the can is inserted into the die. This is an important design feature which takes advantage of the presence of the can, and the pressure generated in the can as result of the can-sleeve seal when air is injected into the deformable support punch, as the means for causing compression of the elastomeric sleeve. The invention may be practiced in a situation in which a trace of a lubricant is applied to the outside wall of the neck of the can prior to necking to reduce friction between the die and the neck. These embodiments in FIGS. 9, 13A, 13B and 14 are preferred in such a situation because they avoid a transfer of the lubricant on the die surface to the elastomeric sleeve when the station is operating without the cans (such as may occur if the supply of cans to the station is temporarily interrupted), and a resulting transfer of the lubricant from the elastomeric sleeve to the interior of the can later on when the supply of cans resumes.

While we have described many presently preferred and alternative embodiments of the invention, persons skilled in the art will appreciate that various further modifications and variation from the disclosed embodiments may me made within the teachings of the foregoing specification, and that the invention is not to be considered limited solely to the disclosed embodiments. These modifications may be dictated by the particular requirements of the can and neck size, the material thickness, and other factors, but nevertheless still come within the sprit of the invention. This true scope and spirit is defined by the appended claims, interpreted in view of the foregoing specification.

We claim:

1. A process for reducing the diameter of a one-piece can with an annular necking die having a transition zone, said can having an open top, a sidewall, a closed bottom, an interior surface, an upper region to be given a reduced diameter in a necking operation with said die, and an upper edge, comprising the steps of:

inserting said can into said die;

producing relative axial movement between said can and said die so that the can enters further into said die so as to force said upper edge past said transition zone to thereby reduce the diameter of said upper edge of said can;

pressing an elastomeric material against said inner surface of said upper region of said can opposite from said transition zone so as to impart a supporting force against said upper region of said can; and moving said can further into said die while maintaining said elastomeric material in pressing engagement with said inner surface of said upper region of said can opposite from said transition zone.

2. The process of claim 1, wherein said can further comprises a transition section separating said upper region from a lower region of said can, and wherein the process further comprises the step of inserting said can further into said die such that the substantially the entire length of said upper region of said can is moved past said transition zone of said die to thereby reduce the diameter of said upper region of said can, while maintaining said elastomeric material in pressing engagement with said interior surface of said can opposite said transition zone.

3. The process of claim 2, further comprising the step of removing said elastomeric material from pressing engagement from said interior surface of said can after the said entire length of said upper region of said can is moved past said transition zone, thereby permitting said can to be readily released from said die.

4. The process of claim 1, wherein said elastomeric material comprises an elastomeric sleeve and said step of pressing comprises the step of placing said elastomeric sleeve inside said interior surface of said can opposite from said transition zone and deforming said elastomeric sleeve laterally into pressing contact with said interior surface of said can.

5. The process of claim 4, wherein said step of pressing further comprises the step of placing a rigid actuator within said die opposite said transition zone of said die with said elastomeric sleeve between said rigid actuator and said die, maintaining said actuator in a stationary position relative to said transition zone of said die, and moving said sleeve relative to said actuator with said movement of said can into said die, said sleeve having an axial length sufficiently great such that said rigid actuator continues to deform a portion of said elastomeric sleeve into pressing contact with said interior surface of said can as said sleeve is moved upwardly with said can into said die.

6. The process of claim 4, wherein said elastomeric material further comprises an inner cylindrical elastomeric block concentric with said elastomeric sleeve, and said step of deforming comprises the step of compressing said elastomeric block and elastomeric sleeve to thereby induce a lateral deformation of said elastomeric sleeve so as to press said elastomeric sleeve into contact with said inner surface of said can.

7. The process of claim 1, wherein is can is made from aluminum and said supporting force applied by said elastomeric material to said can is greater than 15 pounds per square inch and less than 150 pounds per square inch.

8. The process of claim 7, wherein said can is made from aluminum and said supporting force applied by said elastomeric material to said can is between 20 and 80 pounds per square inch.

9. In a necking station for reducing the diameter of an upper region of a can, said can having a one-piece body portion having a sidewall and a closed bottom defining interior and exterior surfaces and an upper region and an upper edge, the necking station comprising an annular necking die having a transition zone, and a punch disposed within said annular necking die and having an elastomeric material on a peripheral portion of said punch, a process for reducing the diameter of said upper region of said can, comprising the steps of:

inserting said can into said necking die;

positioning said elastomeric material adjacent said interior surface of said can opposite said transition zone;

producing relative axial movement between said can and said die so that said can moves further into said annular necking die so as to force said upper edge of said can past said transition zone so as to reduce the diameter of said upper edge of said can, and pressing said elastomeric material against said interior surface of said upper region of said can so as to apply a supporting force against said can opposite said transition zone of said annular necking die while at least a portion of said upper region of said can moves past said transition zone of said annular necking die to reduce the diameter thereof.

10. The process of claim 9, wherein said can comprises a drawn and ironed can.

11. The process of claim 9, wherein said step of pressing comprises the step of deforming said elastomeric material laterally into pressing engagement with said can while said at least a portion of said upper region of said can is moved past said transition zone.

12. The process of claim 11, wherein said elastomeric material comprises cylindrically-shaped sleeve which is deformed laterally by interference with an actuator positioned medially of said sleeve.

13. The process of claim 12, wherein, during said step of pressing, said sleeve moves substantially together with said can relative to said die as said can is inserted further into said die.

14. The process of claim 13, wherein, during said step of pressing, said actuator is maintained in a stationary position relative to said die.

15. The process of claim 9, wherein said step of pressing further comprises the step of pressurizing said interior of said can with a fluid, said fluid acting to compress said elastomeric material and change said elastomeric material from a relaxed state to a compressed state, wherein said elastomeric material is deformed in said compressed state so as to provide said supporting force to said can.

16. The process of claim 15, wherein said elastomeric material comprises an inner cylindrical block of elastomeric material and an outer cylindrical sleeve concentric with said inner cylindrical block, and wherein said inner cylindrical block has a hardness substantially less than the hardness of said outer cylindrical sleeve so as to promote a lateral expansion of said outer cylindrical sleeve when said pressurized fluid is introduced into said can.

17. The process of claim 16, wherein said outer cylindrical sleeve has a hardness of at least 60 Shore A and said inner cylindrical block has a hardness of less than 40 Shore A.

18. The process of claim 17, wherein said outer cylindrical sleeve has a hardness of substantially 95 Shore A and said inner cylindrical block has a hardness of substantially 30 Shore A.

19. The process of claim 9, wherein is can is made from aluminum and said supporting force applied by said elastomeric material to said can is greater than 15 pounds per square inch and less than 150 pounds per square inch.

20. The process of claim 19, wherein said can is made from aluminum and said supporting force applied by said elastomeric material to said can is between 20 and 80 pounds per square inch.

21. The process of claim 9, wherein said step of pressing said elastomeric material against said interior surface of said upper region of said can comprises the step of deforming said sleeve laterally by mechanical interference between said elastomeric material and a rigid actuator.

22. In a necking station for reducing the diameter of an upper region of a can, said can having an interior surface, a deformable support punch for use with said can and a necking die having a transition zone to form a reduced diameter neck on said can, comprising:

a cylindrically-shaped elastomeric sleeve positioned within said necking die;

an actuator positioned medially with respect to said sleeve relative to said die, said actuator making an interference fit with said sleeve to thereby deform said sleeve radially outwardly towards said necking die into supporting engagement with said interior surface of said upper region of said can as said can is inserted into said die and said upper region of said can is moved past said transition zone to reduce the diameter of said upper region of said can.

23. The deformable support punch of claim 22, further comprising:

means for producing relative axial movement between said cylindrically shaped elastomeric sleeve relative to said actuator and said necking die such that said elastomeric sleeve moves upwards into said die as said can is inserted into said die during a necking operation to prevent substantial friction between said can and said sleeve, said elastomeric sleeve having an axial length sufficiently great such that said actuator continues to deform a portion of said elastomeric sleeve into supporting engagement with said interior surface of said can as said sleeve and can enter further into said die.

24. The deformable support punch of claim 22, wherein said sleeve further comprises an inner wall with an upper portion thereof having a diameter D1 and a lower portion having a diameter D2, and wherein said actuator is constructed to have a sleeve engaging portion having a diameter D3, wherein said diameters D1, D2 and D3 are related such that $D1<D3\leqq D2$, whereby said actuator makes an interference fit with said upper portion of said sleeve but does not make an interference fit with said lower portion of said sleeve.

25. The deformable support punch of claim 22, wherein said elastomeric sleeve is made from a material having a hardness rating of at least 60 Shore A.

26. The deformable support punch of claim 22, wherein said elastomeric sleeve is made from a self-lubricating elastomeric material.

27. In a necking station for reducing the diameter of a can having an interior surface and an upper region to be given said reduced diameter, said necking station comprising a source of compressed fluid and a necking die having a transition zone, a deformable support punch for use in conjunction with can and die to form said reduced diameter of said can while substantially preventing the formation of pleats in said can, comprising:

(a) a cylindrically-shaped elastomeric sleeve made from a deformable material;

(b) upper, lower and medial constraints for said sleeve;

(c) conduit means for conducting said compressed fluid into said can when said can is inserted into contact with said die, said compressed fluid exerting compressive forces on said sleeve to deform said sleeve laterally with said sleeve pressed into contact with said interior surface of said can;

(d) means for moving said sleeve relative to said die such that said sleeve and said can are moved farther into said die during a necking operation, wherein said sleeve is deformed laterally into contact with said interior surface of said can into supporting engagement with said interior wall of said can as said upper region of said can is moved past said transition zone to reduce the diameter of said upper region of said can.

28. The deformable support punch of claim 27, wherein said lower constraint comprises a piston moveable axially relative to said upper constraint in response to compressive forces imparted axially onto said piston.

29. The deformable support punch of claim 28, wherein said sleeve is made from a self lubricating material.

30. The deformable support punch of claim 28, wherein said piston further a head portion and a body portion, wherein said body portion is made of a light weight material so as to reduce the mass of said piston.

31. The deformable support punch of claim 27, wherein said assembly further comprises a cylindrical elastomeric block constrained between said upper, medial and lower constraints, concentrically and medially located with respect to said sleeve.

32. The deformable support punch of claim 31, wherein said sleeve has a hardness rating of at least 60 Shore A and said cylindrical elastomeric block has a hardness rating of less than 40 Shore A.

33. The deformable support punch of claim 31, further comprising a projection means positioned above said upper constraint for applying a compressive force to said elastomeric cylindrical block, said projection means cooperating with said piston to deform said cylindrical elastomeric block and induce a lateral deformation in said sleeve.

34. The deformable support punch of claim 27, wherein said upper constraint further comprises a lateral cylindrical surface which has applied thereto an extremely hard, low coefficient of friction.

35. The deformable support punch of claim 34, wherein said coating comprises a diamond coating.

36. A deformable support punch for necking a one-piece can having a open top, a closed bottom and an upper portion having a wall thickness T, the punch for use with an annular necking die having an outer portion separated from a reduced diameter inner portion by a transition zone, said reduced diameter inner portion having a diameter ØM and a means for placing said punch within said open top of said can during a necking operation, the deformable support punch comprising:

an elastomeric material forming a lateral surface extending circumferentially around the periphery of said punch;

upper, lower and medial restraints on said elastomeric material;

said elastomeric material having a diameter greater than said diameter ØM of said reduced diameter inner portion of said minus twice said wall thickness T of said can;

whereby relative axial movement between said can elastomeric material and said die such said elastomeric material is moved past said transition zone into said interior region of said die promotes an interference between said elastomeric material and said can to thereby provide supporting forces to said can as said can is moved past said transition zone to reduce the diameter thereof.

* * * * *